US009468841B2

(12) United States Patent
Stellenberg

(10) Patent No.: US 9,468,841 B2
(45) Date of Patent: Oct. 18, 2016

(54) PINBALL MACHINE WITH CONFIGURABLE PLAYFIELD

(71) Applicant: Multimorphic, Inc., Austin, TX (US)

(72) Inventor: Gerald Stellenberg, Austin, TX (US)

(73) Assignee: Multimorphic, Inc., Austin, TX (US)

( * ) Notice: Subject to any disclaimer, the term of this patent is extended or adjusted under 35 U.S.C. 154(b) by 158 days.

(21) Appl. No.: 13/866,488

(22) Filed: Apr. 19, 2013

(65) Prior Publication Data

US 2013/0228970 A1 Sep. 5, 2013

Related U.S. Application Data

(63) Continuation-in-part of application No. 13/734,151, filed on Jan. 4, 2013.

(60) Provisional application No. 61/632,002, filed on Jan. 17, 2012, provisional application No. 61/632,749, filed on Jan. 31, 2012, provisional application No. 61/633,559, filed on Feb. 14, 2012, provisional application No. 61/687,307, filed on Apr. 23, 2012, provisional application No. 61/690,882, filed on Jul. 9, 2012.

(51) Int. Cl.

| | |
|---|---|
| ***A63F 9/24*** | (2006.01) |
| ***A63F 7/26*** | (2006.01) |
| ***A63F 7/02*** | (2006.01) |
| ***A63F 3/00*** | (2006.01) |

(52) U.S. Cl.

CPC ..... *A63F 7/26* (2013.01); *A63F 3/0052* (2013.01); *A63F 3/00643* (2013.01); *A63F 7/027* (2013.01); *A63F 2003/00662* (2013.01); *A63F 2009/246* (2013.01)

(58) Field of Classification Search

USPC ..... 463/1, 16, 20

See application file for complete search history.

(56) References Cited

U.S. PATENT DOCUMENTS 4,015,847 A * 4/1977 Myers ..... 273/121 R
6,036,188 A 3/2000 Gomez (Continued)

OTHER PUBLICATIONS

Pinball News, P3 Pinball Platform, published on Mar. 23, 2012 at http://www.pinballnews.com/learn/p3, last accessed on Dec. 28, 2012.

(Continued)

*Primary Examiner* — Paul A D'Agostino
*Assistant Examiner* — Ankit Doshi
(74) *Attorney, Agent, or Firm* — Davenport IP Law, PLLC

(57) ABSTRACT

Pinball machines with configurable playfields. A method includes detecting an event during a game played at least in part over a surface of a playfield in a pinball machine, the playfield having a first and a second playfield portions with two outermost lateral edges between which the game takes place, and, in response to the event, electronically activating a playfield reducer located between the first and second portions, the playfield reducer configured to extend between the two outermost lateral edges of the playfield portions in a manner sufficient to prevent the pinball from traveling between the first and second playfield portions. A machine includes a main playfield portion having a set pinball components disposed therein, the components configured to interact with a pinball during a game, the main playfield portion further configured to receive any of a plurality of modular playfields, each of the modular playfields having different sets components.

20 Claims, 16 Drawing Sheets

(56) References Cited

U.S. PATENT DOCUMENTS

| | | | | |
|---|---|---|---|---|
| 2005/0245302 | A1* | 11/2005 | Bathiche et al. | 463/1 |
| 2010/0160016 | A1* | 6/2010 | Shimabukuro et al. | 463/16 |
| 2011/0263312 | A1* | 10/2011 | De Waal et al. | 463/20 |

OTHER PUBLICATIONS

Pinball News, P3 Update:Team Adds New Game Designer, published on Dec. 5, 2012 at http://www.pinballnews.com/games/p3/index4.html, last accessed on Dec. 28, 2012.

* cited by examiner

PINBALL MACHINE WITH CONFIGURABLE PLAYFIELD

CROSS-REFERENCE TO RELATED APPLICATIONS

This application claims priority to, and is a continuation-in-part (CIP) of, U.S. patent application Ser. No. 13/734,151 filed on Jan. 4, 2013, which claims the priority of U.S. Provisional Patent Application No. 61/632,002 filed on Jan. 17, 2012, of U.S. Provisional Patent Application No. 61/632,749 filed on Jan. 31, 2012, and of U.S. Provisional Patent Application No. 61/633,559 filed on Feb. 14, 2012, the disclosures of which are hereby incorporated by reference herein in their entirety. This application also claims priority to: U.S. Provisional Patent Application No. 61/687,307 filed on Apr. 23, 2012, and U.S. Provisional Patent Application No. 61/690,882 filed on Jul. 9, 2012, the disclosures of which are hereby further incorporated by reference herein in their entirety.

FIELD

This document relates generally to gaming devices, and more specifically, to pinball machines with configurable playfields.

BACKGROUND

A pinball machine is an entertainment or amusement device usually found in a variety of public places such as arcades, restaurants, bars, clubs, etc., but sometimes also present in private residences and other environments. Generally speaking, a conventional or traditional pinball machine allows players to play a game in which points are earned by physically manipulating one or more steel balls on a slightly inclined playfield within a glass-covered cabinet.

The pinball machine's playfield typically includes one or more physical targets. When a ball strikes a particular physical target, an electromechanical switch coupled to (or otherwise integrated into) the target detects the mechanical impact, which then triggers a change in some aspect of the game. For example, in some cases, when a ball hits a given target, a player may score a predetermined amount of points.

In most pinball implementations, a "hole" or "drain" is located at the bottom portion of the playfield. Usually, if the ball falls into the drain, the game ends or another ball is provided to the player. Mechanical "flippers" capable of at least partially covering the drain may allow a skilled player to hit the ball at an appropriate time so as to prevent it from falling into the drain, thus putting that same ball back in play and extending the duration of the game.

SUMMARY

Pinball machines with configurable playfields are described. In an illustrative, non-limiting embodiment, a method may include detecting an event during a game played at least in part over a surface of a playfield in a pinball machine, the playfield having a first and a second playfield portions, the first and second playfield portions having two outermost lateral edges between which the game takes place; and, in response to the event, electronically activating a playfield reducer located between the first and second portions, the playfield reducer configured to extend between the two outermost lateral edges of the playfield portions in a manner sufficient to prevent the pinball from traveling between the first and second playfield portions. For example, the first playfield portion may have an electronic screen configured to display one or more virtual elements capable of interacting with a pinball, and the second playfield portion may have one or more elements configured to return the pinball to the first playfield portion.

In some implementations, detecting the event may include determining that one or more software-based conditions is met, the software-based conditions selected from the group consisting of: reaching of a predetermined score, failing to reach the predetermined score, reaching of a predetermined game stage, passage of a predetermined amount of time, and user selection. Also, detecting the event may include electronically determining a physical property of a physical object, the physical object allowed to move above the electronic screen; and determining that the physical property matches one or more event conditions.

In some cases, the physical object may be selected from the group consisting of: the pinball, a flipper, a slingshot, a kicker, a bumper, a target, a plunger, a hole, a saucer, a spinner, a gate, a switch, a stopper, a ramp, or a magnet. Moreover, the physical property may be selected from the group consisting of: a position of the physical object on the first playfield portion, a speed of the physical object over the first playfield portion, and a direction of movement of the physical object across the first playfield portion.

The playfield reducer may include a barrier, and activating the playfield reducer may include causing the barrier to rise above a surface of the first playfield portion. Additionally or alternatively, the playfield reducer may include a hole, and activating the playfield reducer may include uncovering the hole. Additionally or alternatively, the playfield reducer may include a combination of one or more barrier elements and one or more hole elements, and activating the playfield reducer may include causing the one or more barrier elements to rise above a surface of the first playfield portion and uncovering the one or more hole elements. In some cases, a first element of the playfield reducer may be located in the first playfield portion, and a second element of the playfield reducer may be located in the second playfield portion.

In another illustrative, non-limiting embodiment, a pinball machine may include a main playfield portion having a set of one or more pinball components disposed therein, the set of one or more pinball components configured to interact with a pinball during a pinball game, the main playfield portion further configured to receive any of a plurality of interchangeable modular playfield portions, each of the plurality of interchangeable modular playfield portions having different sets of one or more pinball components. The pinball machine may also include a memory configured to store instructions; and processing circuitry operably coupled to the memory, the processing circuitry configured to execute the instructions to cause the pinball machine to: identify one of a plurality of interchangeable modular playfield portions; and change an aspect of the pinball game based upon the identification.

For example, to identify the interchangeable modular playfield portion, the processing circuitry may be configured to execute the instructions to cause the pinball machine to detect that the interchangeable modular playfield portion has been coupled to the pinball machine. Also, to change the aspect of the pinball game, the processing circuitry may be configured to execute the instructions to cause the pinball machine to retrieve predetermined game settings from a database, the predetermined game settings configured to enable the pinball machine to control the one or more different components. In some cases, the database may be accessible to the pinball machine over a computer network. Moreover, the one or more pinball components may be reconfigurable by a user, and the processing circuitry may be further configured to execute the instructions to cause the pinball machine to detect a configuration of the one or more different components and change the aspect of the pinball game based upon the detection.

In yet another illustrative, non-limiting embodiment, a non-transitory computer-readable storage medium may have program instructions stored thereon that, upon execution by a processor within a pinball machine, cause the pinball machine to: identify one of a plurality of interchangeable modular playfield portions, each of the plurality of interchangeable modular playfield portions having one or more different components configured to interact with a pinball during a pinball game, the identified interchangeable modular playfield portion having been coupled to the pinball machine by an end-user; and monitor or control at least one of the different components during the pinball game. In some cases, the at least one component may include a playfield reducer configured to prevent the pinball from traveling between a main playfield portion and the identified interchangeable modular playfield portion.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods disclosed herein are directed to pinball machines with modular playfields and methods of operating the same. Generally speaking, some of these systems and methods may be incorporated into, or otherwise combined with, a wide range of other entertainment or amusement devices, including, but not limited to, video games, electro-mechanical games, redemption games, merchandisers, billiards, shuffleboards, table football ("Foosball"), table tennis ("Ping-Pong"), air hockey tables, etc. These systems and methods may also be incorporated into gambling devices, such as slot machines, pachinko machines, or the like. It should be noted, however, that some of the techniques discussed herein may be uniquely applicable to devices that allow a player to manipulate a physical object within a playfield without directly touching that physical object (e.g., pinball machines).

Figure 1:
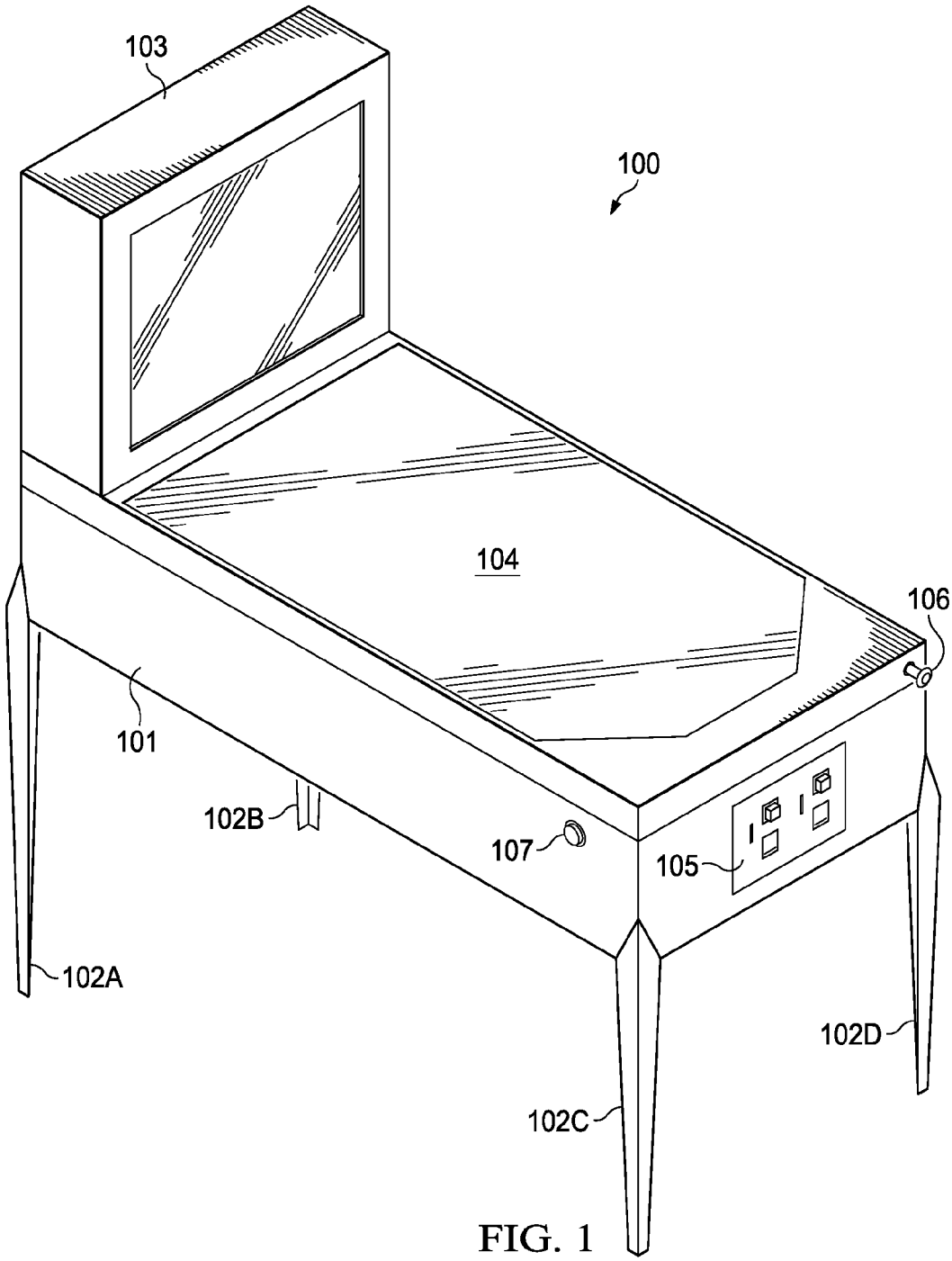
FIG. 1 is a three-dimensional, auxiliary view of an example of a pinball machine according to some embodiments.

Turning to FIG. 1, a three-dimensional, auxiliary view of an example of pinball machine 100 is depicted according to some embodiments. As illustrated, cabinet 101 stands on legs 102A-D, although in other implementations legs 102A-D may be absent and cabinet 101 may sit on a stand, desk, table, countertop, or the like. Cabinet 101 includes hybrid playfield 104, where a game of pinball may take place. Examples of hybrid playfield 104 are discussed in more detail below. In some cases, legs 102A and 102B may be slightly longer than legs 102C and 102D, such that playfield 104 may have an angle of approximately 3.5° to 10.5° with respect to the ground ("pitch"). In other cases, legs 102A-D may each have the same length, and cabinet 101 may be constructed so as to provide a suitable pitch to hybrid playfield 104.

Vertical portion 103 may include one or more electronic displays, video cameras, loudspeakers, etc. Generally speaking, vertical portion 103 may include or otherwise present certain audio-visual information, whether related or unrelated to a pinball game playable on machine 100 (e.g., promotional or marketing materials, etc.).

To enable a player to play a pinball game, front control(s) 105 may allow the user or player to deposit money or tokens into machine 100. As such, front control(s) 105 may include, for example, a credit, coin or token receiver, a magnetic card reader, a Radio Frequency Identification (RFID) scanner, or the like. Front control(s) 105 may also include one or more buttons that allow a user to select a number of players for a particular game, or to simply to start a pinball game. Meanwhile, side control(s) 107 and playfield control(s) 106 allow the user to operate one or more physical objects within hybrid playfield 104. As an example, side control(s) 107 (and/or a corresponding control on the opposite side of cabinet 101, not shown) may include one more buttons that allow a player to control mechanical "flippers." As another example, playfield control(s) 106 may include one or more buttons or mechanisms that allow the player to control a "plunger" element configured to put a steel ball in play during a pinball game.

Here it should be noted that pinball machine 100 is provided by way of illustration only. In different applications, machine 100 may assume a variety of shapes and forms. Furthermore, one or more components discussed above may be absent or different from what is depicted in FIG. 1. For example, in some cases, front control(s) 105 may be located elsewhere on machine 100, and, in other cases, may include more or fewer elements than shown. For instance, when designed for residential or personal use, machine 100 may not be credit, coin or token-operated. Similarly, side control(s) 107 and/or playfield control(s) 106 may be replaced with motion detection devices (e.g., integrated into vertical portion 103), or may not be necessary for certain games. For example, if steel balls are provided within playfield 104 via an internal mechanism within machine 100, then playfield control(s) 106 may not be necessary.

Figure 2:
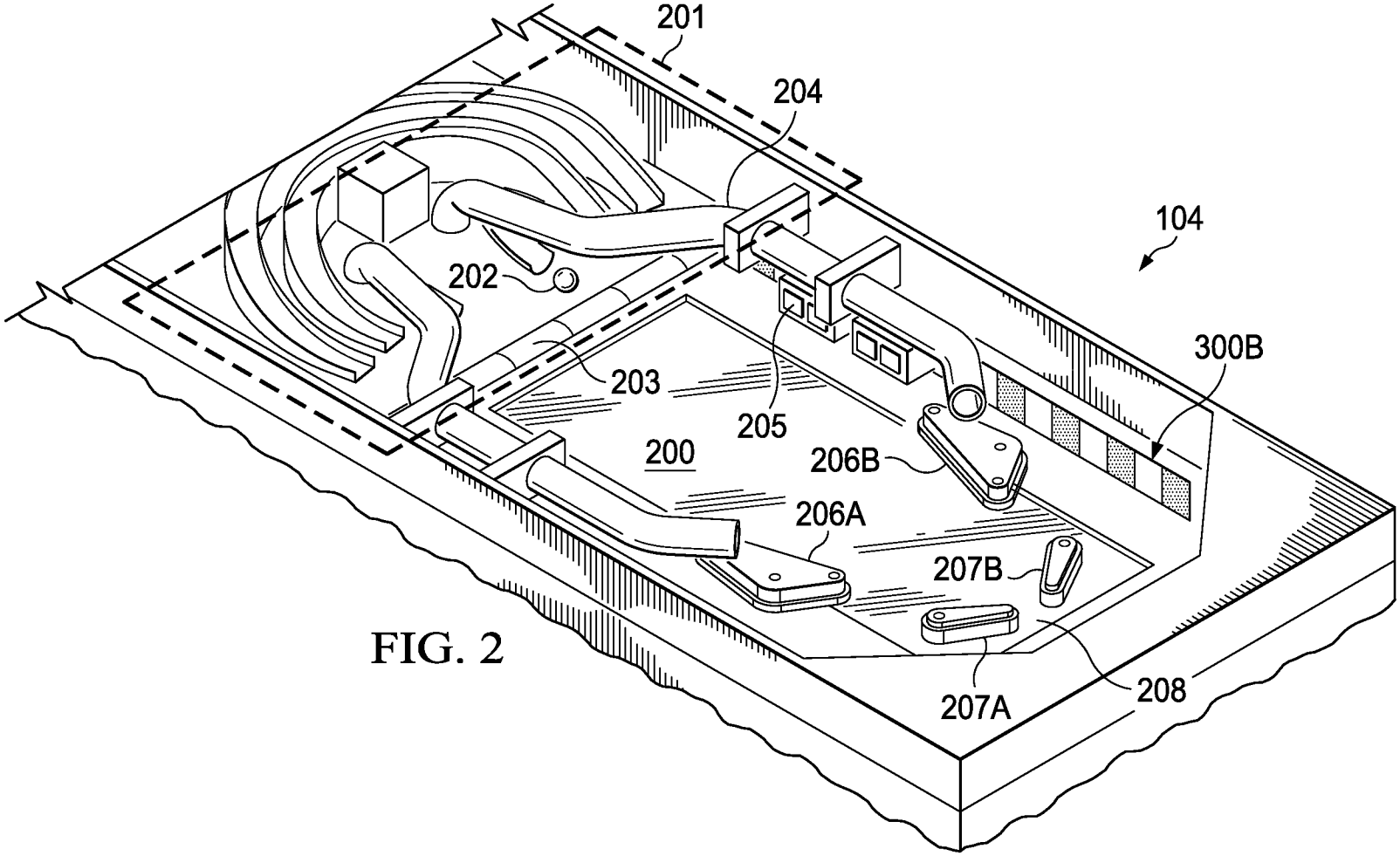
FIG. 2 is a three-dimensional, auxiliary view of an example of a hybrid playfield according to some embodiments.

FIG. 2 is a three-dimensional, auxiliary view of an example of hybrid, configurable playfield 104 according to some embodiments. Generally speaking, a "playfield" is a mostly flat surface over which one or more objects, such as ball 202, move in an amusement game, such as a pinball game. Hybrid playfield 104 is a playfield comprising a "physical space" and a "virtual space." The physical space may include one or more mechanical or electromechanical elements, also referred to herein as "physical objects." Electronic display 200 may provide the virtual space portion of hybrid playfield 104 by rendering one or more graphical elements referred to herein as "virtual objects." Configurable and modular aspects of hybrid playfield 104 are discussed with respect to FIGS. 14-22 below.

In the case of a pinball machine, examples of hybrid playfield 104's physical objects include, but are not limited to, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc. Meanwhile, virtual objects may include any graphical or digital element that may be rendered on electronic display 200, such as, for example, artwork, colors, images, animations, photographs, designs, etc.

In various implementations, systems and methods described herein may allow certain physical objects to cause changes to certain virtual objects and/or vice-versa. Accordingly, these systems and methods may create an impression or an illusion upon a player that physical and virtual elements are interacting during a game, for example, in a physical or mechanical manner.

In the illustrated embodiment, hybrid playfield 104's physical objects include modular portion 201 configured to deploy one or more ball(s) 202 onto the playfield during a game. In this example, modular portion 201 includes barrier element(s) 203 and pipe element(s) 204. Barrier element(s) 203 may include one or more walls that can pop-up and at least partially block ball 202 from transiting between modular portion 201 and other portion(s) of hybrid playfield 104. In some cases, barrier element(s) 203 may act as a "trap" to cause ball 202 to fall under the surface of hybrid playfield 104 or become more or less static for a predetermined amount of time (e.g., by including an electromagnet or the like), for example. Meanwhile, pipe element(s) 204 may allow ball 202 to travel through predetermined paths or "shortcuts" when traveling within hybrid playfield 104.

Once deployed, ball 202 may tend to roll towards drain 208 depending upon the pitch of playfield 104 and absent action by a player operating flippers 207A and/or 207B. Flippers 207A and/or 207B are mechanically or electromechanically-controlled levers used for redirecting ball 202 up playfield 104, preventing ball 202 from falling into drain 208. Through the use of careful, skillful timing, a player may also be to manipulate flippers 207A and/or 207B to intentionally direct ball 202 in a selected direction with a given speed, thus causing ball 202 to hit various types of scoring targets, such as, for example, one or more trigger elements 205 and/or slingshots 206A and 206B.

With respect to hybrid playfield 104's virtual objects, electronic display 200 may be any suitable display or monitor (e.g., a Liquid Crystal Display (LCD) or the like) configured to present graphical designs and/or animations to a player. These virtual objects are configurable depending upon the design of a game, and may interact with certain physical objects in hybrid playfield 104. In some implementations, electronic display 200 may be capable of rendering 2D virtual objects on a flat screen. Additionally or alternatively, electronic display 200 may be capable of producing 3D and/or holographic virtual objects.

Although shown as a single display in FIG. 2, in other embodiments two or more electronic displays 200 may be disposed in playfield 104. For example, in some cases, a first electronic display and a second electronic display may be positioned side-by-side. In other cases, four electronic displays may be arranged such that each occupies a different quadrature of playfield 104. Furthermore, in some cases, electronic display 200 may be at least in part co-extensive with the surface of hybrid playfield 104.

As discussed in more detail below, ball 202 may cause one or more virtual objects rendered by electronic display 200 to appear, disappear, or change depending upon its position on hybrid playfield 104. Similarly, when ball 202 physically interacts with trigger element 205 and slingshots 206A and 206B, for example, one or more virtual objects presented on electronic display 200 may change their behavior in an appropriate manner. Conversely, virtual objects rendered on electronic display 200 may also behave in a way so as to cause a change in one or more of trigger element 205 and slingshots 206A and 206B, for example, thus appearing to a player as if a physical interaction between the virtual object and the physical object has taken place.

In some cases, in order to enable one or more of the foregoing operations, a tracking system may be disposed within machine 100 to determine a position of ball 202 and/or other physical objects. For instance, one or more arrays of infrared (IR) transducers may be disposed immediately above the surface of hybrid playfield 104 along one or more sides of electronic display 200.

Figure 3:
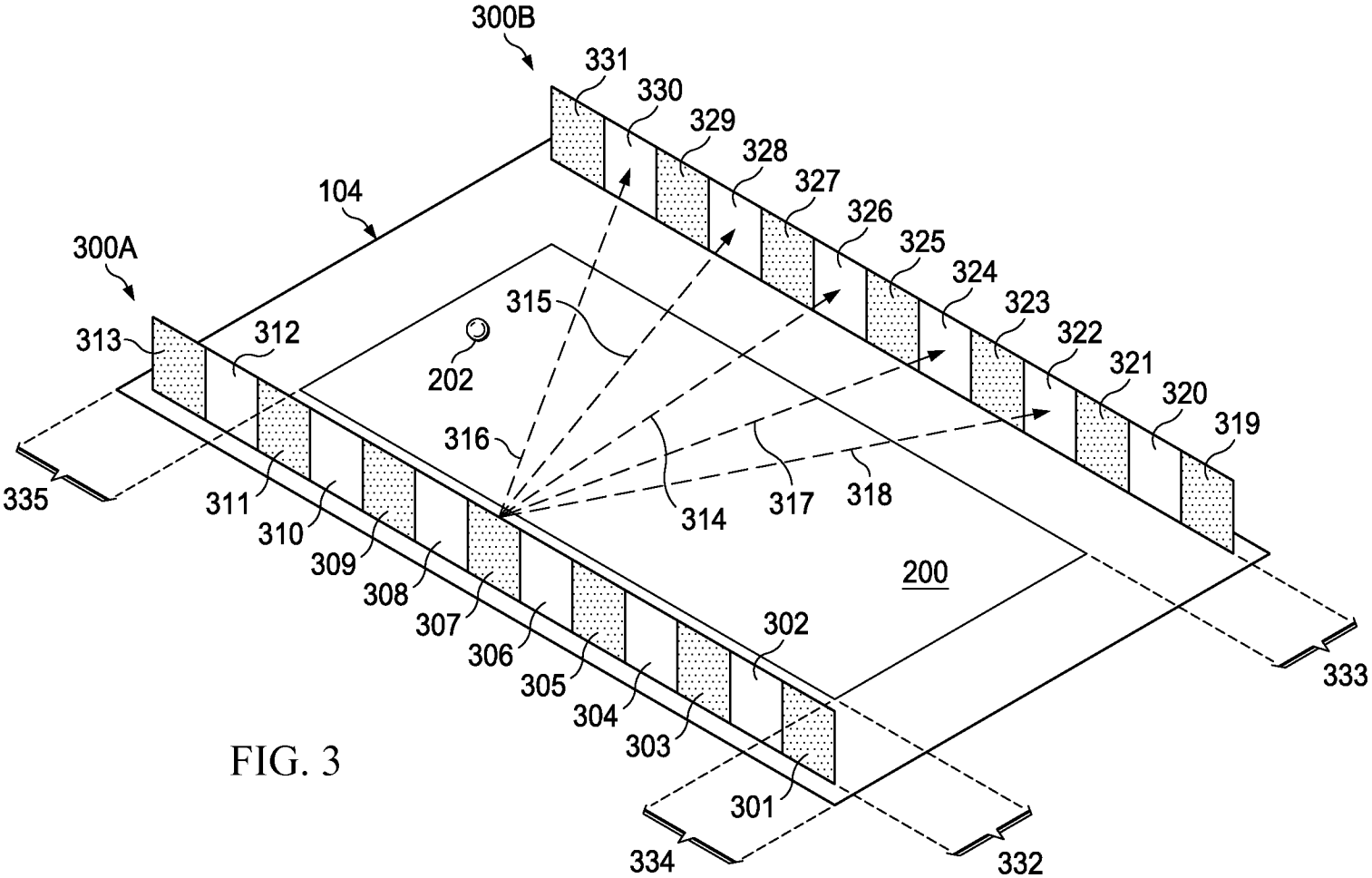
FIG. 3 is a three-dimensional, auxiliary view of an example of a tracking system in a hybrid playfield according to some embodiments.

Turning now to FIG. 3, a three-dimensional, auxiliary view of an example of tracking system 300 in hybrid playfield 104 is depicted according to some embodiments. As illustrated, tracking system 300 includes first IR transducer array 300A and second IR transducer array 300B. Arrays 300A and 300B are disposed immediately above the surface of playfield 104 on opposite sides of electronic display 200, and may be positioned such that other playfield components (e.g., trigger element 205, slingshots 206A and 206B, flippers 207A and 207B, etc.) do not interfere with its operations—that is, so that array 300A may have a least a partial direct line-of-sight with respect to array 300B. For instance, one or more of these playfield components may be "floating" with respect to electronic display 200 (e.g., attached or coupled to the top or cover of hybrid playfield 104).

In this example, arrays 300A and 300B are positioned at distances 332 and 333 from the sides of electronic display 200, and are longer than the height of electronic display 200 by lengths 334 and 335. In some implementations, distances and lengths 332-335 may be selected to avoid interfering with gameplay (i.e., without blocking ball 202's access to modular portion 201 or drain 208). Also, in cases where electronic display 200 extends to the edge of hybrid playfield 104, one or more of distances and lengths 332-335 may be zero and/or transducer arrays 300A and 300B may be positioned outside of hybrid playfield 104.

In this embodiment, IR transducer array 300A includes transmitter elements 301, 303, 305, 307, 309, 311, and 313 alternating with receiver or detector elements 302, 304, 306, 308, 310, and 312. Second IR transducer array 300B includes transmitter elements 319, 321, 323, 325, 327, 329, and 331 alternating with receiver or detector elements 320, 322, 324, 326, 328, and 330. It should be noted, however, that this particular configuration is provided for ease of explanation only, and that many other suitable configurations with a different number of arrays, transmitter elements, and detector elements may be used, sometimes in the same pinball machine 100. For instance, in other embodiments, tracking system 300 may include RF triangulation systems, video based motion tracking systems, capacitive systems, or other electro-mechanical position detection systems.

Figure 7:
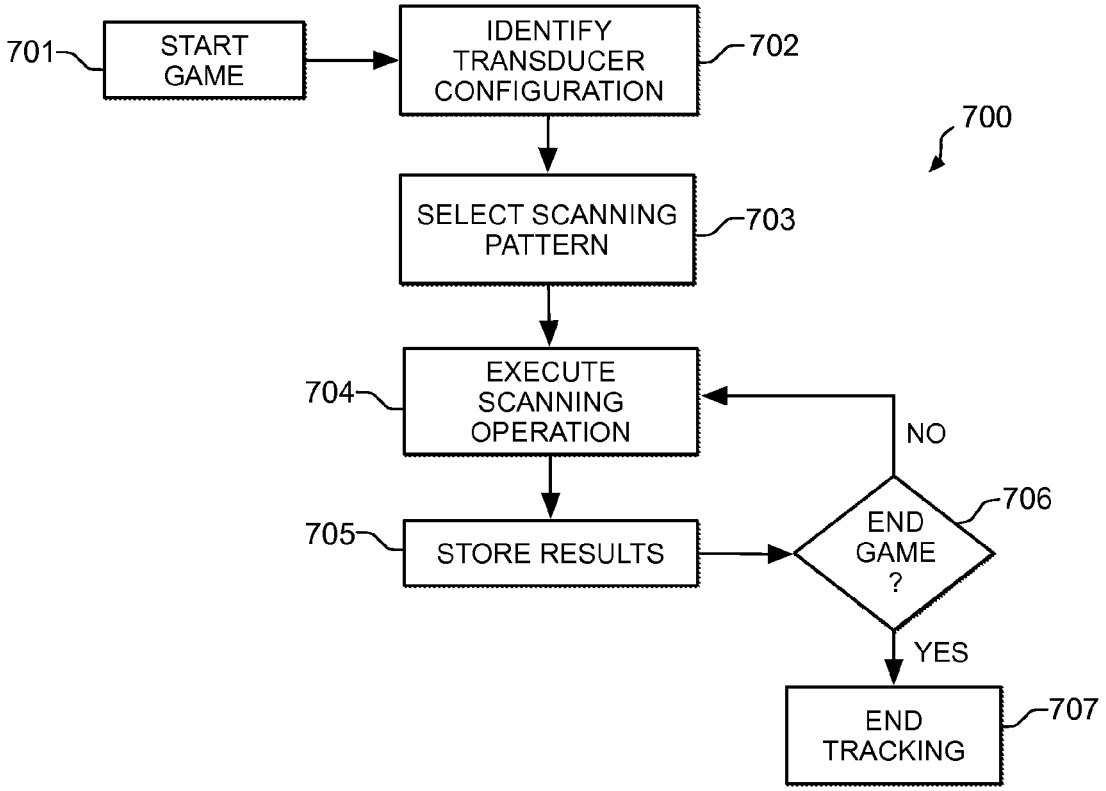
FIG. 7 is a flowchart of an example of a method of operating a tracking system in a hybrid playfield according to some embodiments.
Figure 8:
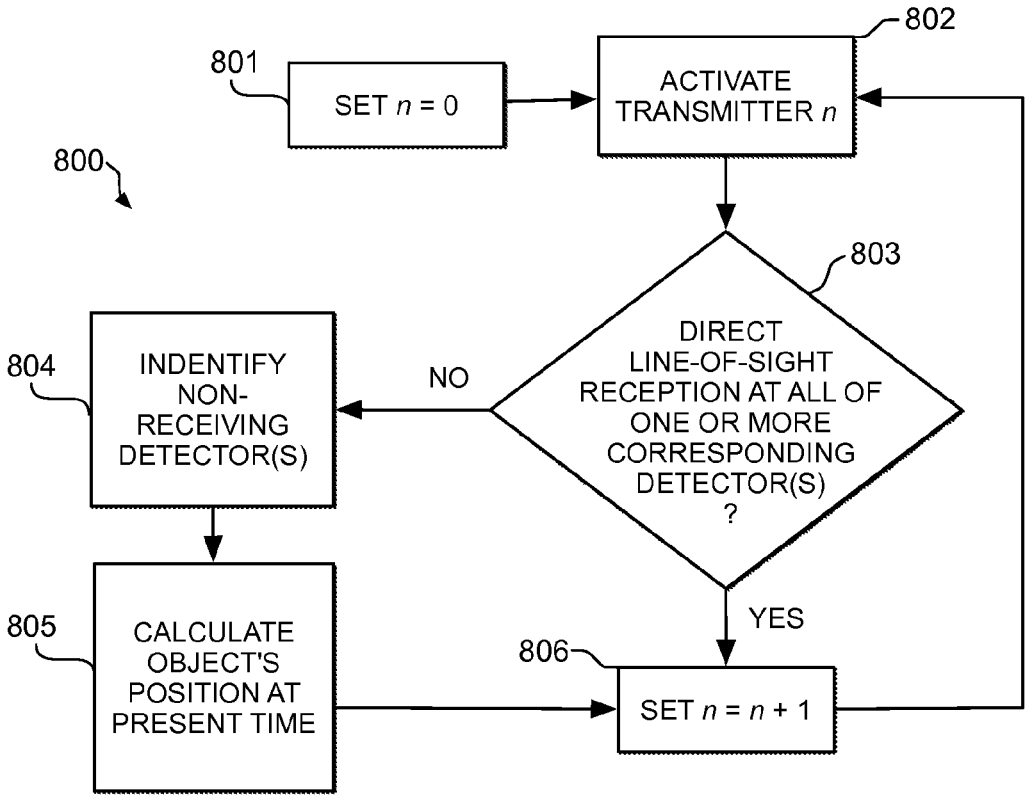
FIG. 8 is a flowchart of an example of a method of obtaining an object's position in a hybrid playfield using a tracking system according to some embodiments.

Tracking system 300 may be configured to scan hybrid playfield 104, for example, as explained in FIGS. 7 and 8. Briefly, each of transmitter elements 301, 303, 305, 307, 309, 311, and 313 of first array 300A may transmit IR signals in succession such that one or more of detector elements 320, 322, 324, 326, 328, and/or 330 of second array 300B receives these signals. Then, each of transmitter elements 319, 321, 323, 325, 327, 329, and 331 of second array 300B may transmit IR signals in succession such that one or more of detector elements 302, 304, 306, 308, 310, and/or 312 of first array 300A receives those signals. By determining which of detector elements 302, 304, 306, 308, 310, 312 320, 322, 324, 326, 328, and/or 330 were expected to receive their respective signals but did not, for example, because ball 202 was blocking that detector's line-of-sight, tracking system 300 may determine the position of ball 202 as it moves across hybrid playfield 104.

In some embodiments, tracking system 300 may be configured to determine the position, speed, and/or direction of movement of a physical object over hybrid playfield 104 with a margin of error no larger than the size of the physical object itself. Tracking system 300 may also be configured to determine the identification of a particular physical object, for example, when two balls 202 occupy hybrid playfield 104 simultaneously (e.g., via a chip or tag included in each ball 202, by maintaining a record of which ball gets deployed at what time and their respective trajectories, etc.). In some implementations, two or more tracking systems 300 may be used in the same hybrid playfield 104, and each of the two or more tracking systems 300 may be of a different type (e.g., an IR system and an RFID system, etc.).

Figure 4:
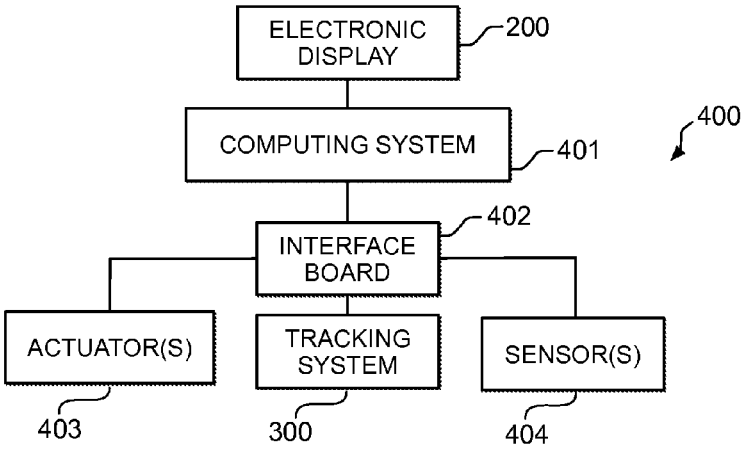
FIG. 4 is a block diagram of an example of hardware elements of a pinball machine with a hybrid playfield according to some embodiments.

FIG. 4 is a block diagram of an example of hardware elements 400 in pinball machine 100 with hybrid playfield 104 according to some embodiments. As shown, computing system or controller 401 is coupled to electronic display 200 of FIG. 2. Computing system 401 is also coupled to (or otherwise includes) interface board 402, which in turn is coupled to tracking system 300, actuator(s) 403, and/or sensor(s) 404.

In operation, computing system 401 may be configured to control electronic display 200 by providing one or more video signals capable of being rendered by electronic display 200 to create one or more 2D or 3D virtual objects in hybrid playfield 104 during a pinball game. Also, through interface board 402, computing system 401 may be configured to control the behavior of and/or to receive information related to physical objects in hybrid playfield 104 through interface board 402.

In some embodiments, interface board 402 may be any suitable pinball controller device such as, for example, the "Pinball—Remote Operations Controller" or "P-ROC" controller available from Multimorphic, Inc., which enables a computer to control a pinball machine over Universal Serial Bus (USB). It should be noted, however, that other pinball controller devices may be used as interface board 402, and that such a device may communicate with computing device 401 using any suitable bus and/or communication protocol.

In some cases, interface board 402 may be configured to control actuator(s) 403, such as, for example, coils, motors, etc. to thereby affect the behavior or status of physical elements, such as, for example, ball 202, barrier element 203, pipe element 204, trigger element 205, slingshots 206A and 206B, flippers 207A and 207B, or the like. Moreover, interface board 402 may be configured to receive information from sensor(s) 404 such as, for example, switches, optical sensors, etc., to determine the status of those physical objects. With regard to certain physical objects, such as, for example, ball 202, interface board 402 may also be configured to control tracking system 300 to obtain position and other information about those elements.

Figure 5:
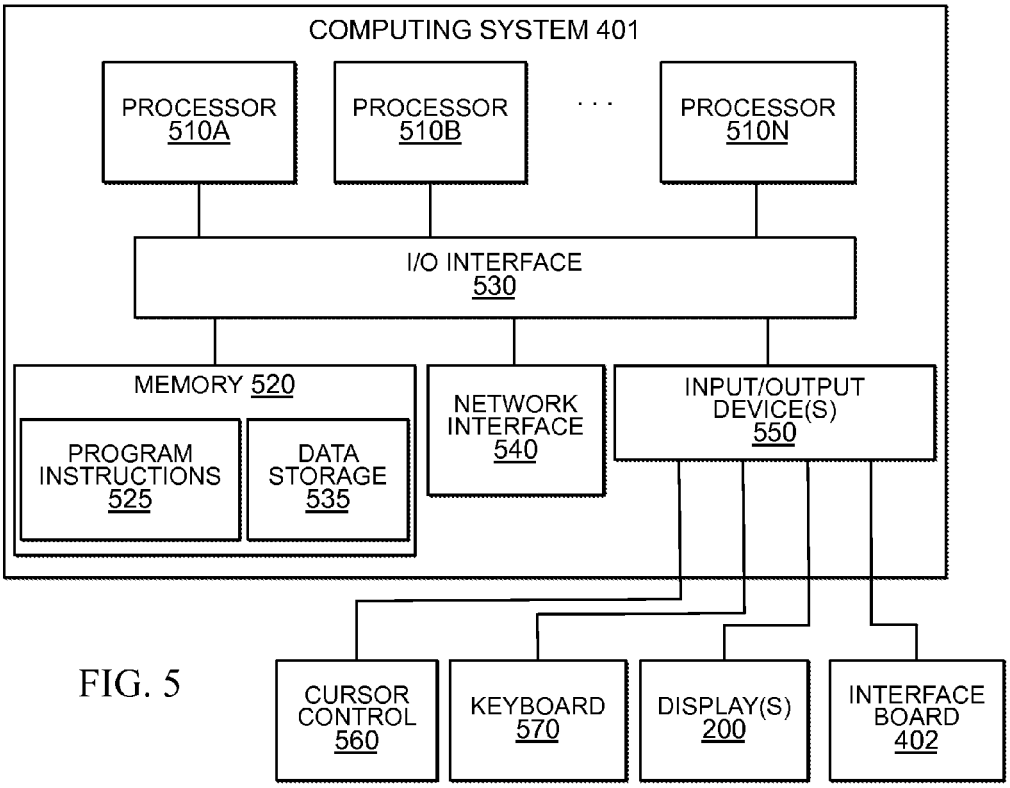
FIG. 5 is a block diagram of an example of a computing system or controller configured to implement aspects of a pinball machine with a hybrid playfield according to some embodiments.

FIG. 5 is a block diagram of an example of computing system 401 configured to implement aspects of pinball machine 100 with a hybrid playfield 104. In some embodiments, computing system 401 may be a server, a mainframe computer system, a workstation, a network computer, a desktop computer, a laptop, or the like. In other embodiments, one or more of the components described in connection with computing system 401 may be provided as a System-On-Chip (SoC), Application Specific Integrated Circuit (ASIC), or the like. More generally, however, computing system 401 may be any system, device, or circuitry capable of implementing or executing one or more of the various operations described herein.

In some implementations, computer system 401 may include one or more processors 510A-N coupled to a system memory 520 via an input/output (I/O) interface 530. Computing system 401 may further include a network interface 540 coupled to I/O interface 530, and one or more input/ output devices 550, such as cursor control device 560, keyboard 570, electronic display(s) 200, and interface board 402.

In various embodiments, computing system 401 may be a single-processor system including one processor 510A, or a multi-processor system including two or more processors 510A-N (e.g., two, four, eight, or another suitable number). Processor(s) 510A-N may be any processor capable of executing program instructions. For example, in various embodiments, processor(s) 510A-N may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processor(s) 510A-N may commonly, but not necessarily, implement the same ISA. Also, in some embodiments, at least one processor(s) 510A-N may be a graphics processing unit (GPU) or other dedicated graphics-rendering device.

System memory 520 may be configured to store program instructions and/or data accessible by processor(s) 510A-N. In various embodiments, system memory 520 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described herein, may be stored within system memory 520 as program instructions 525 and data storage 535, respectively. In other embodiments, program instructions and/or data may be received, sent or stored upon different types of computer-accessible media or on similar media separate from system memory 520 or computing system 401. Generally speaking, a computer-accessible medium may include any tangible, non-transitory storage media or memory media such as magnetic or optical media—e.g., disk or CD/DVD-ROM coupled to computing system 401 via I/O interface 530.

The terms "tangible" and "non-transitory," are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor(s) 510A-N). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor(s) 510A-N.

Network interface 540 may be configured to allow data to be exchanged between computing system 401 and other devices attached to network 115, such as other computer systems, or between nodes of computing system 401. In various embodiments, network interface 540 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

Input/output devices 550 may, in some embodiments, include one or more display terminals, keyboards, keypads, touch screens, scanning devices, voice or optical recognition devices, or any other devices suitable for entering or retrieving data by one or more computing system 401. Multiple input/output devices 550 may be present in computing system 401 or may be distributed on various nodes of computing system 401. In some embodiments, similar input/output devices may be separate from computing system 401 and may interact with one or more nodes of computing system 401 through a wired or wireless connection, such as over network interface 540.

As shown in FIG. 5, memory 520 may include program instructions 525, configured to implement certain embodiments described herein, and data storage 535, comprising various data accessible by program instructions 525. In an embodiment, program instructions 525 may include software elements of embodiments illustrated in FIG. 2. For example, program instructions 525 may be implemented in various embodiments using any desired programming language, scripting language, or combination of programming languages and/or scripting languages (e.g., C, C++, C#, JAVA®, JAVASCRIPT®, PERL®, etc.). Data storage 535 may include data that may be used in these embodiments. In other embodiments, other or different software elements and data may be included.

A person of ordinary skill in the art will appreciate that computing system 401 is merely illustrative and is not intended to limit the scope of the disclosure described herein. In particular, the computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be performed and/or other additional operations may be available. Accordingly, systems and methods described herein may be implemented or executed with other configurations.

Figure 6:
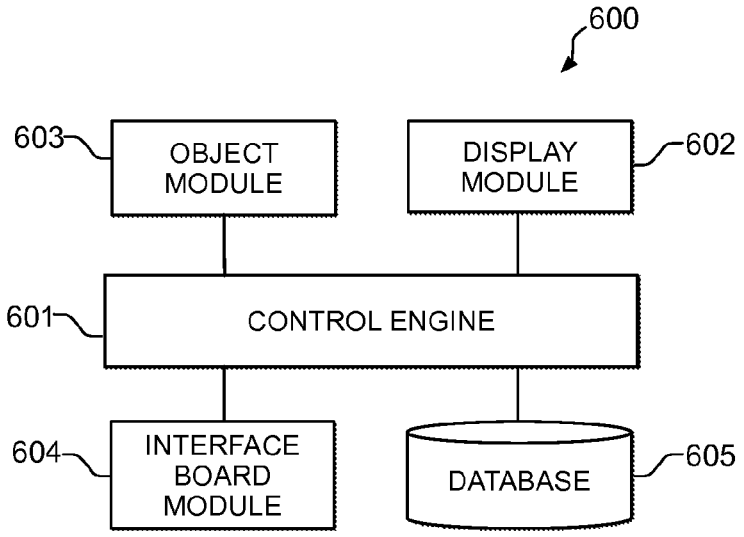
FIG. 6 is a block diagram of an example of a software program configured to implement aspects of a pinball machine with a hybrid playfield according to some embodiments.

FIG. 6 is a block diagram of an example of software program 600 configured to implement aspects of pinball machine 100 with a hybrid playfield 104. In some embodiments software 600 may be executed by computing system 401 described above. For example, in some cases, software program 600 may be implemented as program instructions 525 of FIG. 5. Generally speaking, control engine 601 may include one or more routines configured to implement one or more of the various techniques described herein. For instance, control engine 601 may include one or more routines configured to allow a user to select a game stored in database 605. Control engine 601 may also include one or more routines configured to allow a user to start or terminate a game, as well as one or more routines configured to manage progress of a game.

Display module 602 may provide a software interface between computing device 401 and electronic display 200 such that images produced by display module 602 are rendered in electronic display 200 under control of control engine 401. Interface board module 604 may provide a software interface between computing device 401 and interface board 402. Through interface board module 402, control engine 401 may determine that one or more sensor(s) 404 have been activated and/or it may control, via actuator(s) 403, a physical aspect of a physical object in hybrid playfield 104. Control engine 401 may also receive tracking information from tracking system 300 via interface board module 402.

Object module 603 may keep track of one or more graphical elements or virtual objects being displayed (or yet to be displayed) on electronic display 200 via display module 602, including, for example, a virtual object's characteristics such as the object's identification, boundaries, shape, color, size, texture, position (on electronic display 200), speed, direction of movement, etc. Object module 603 may also keep a record of the received tracking information for one or more physical objects including, for example, an identification of the physical object, its position (above electronic display 200), speed, direction of movement, shape, etc.

In some embodiments, the modules or blocks shown in FIG. 6 may represent processing circuitry and/or sets of software routines, logic functions, and/or data structures that, when executed by the processing circuitry, perform specified operations. Although these modules are shown as distinct logical blocks, in other embodiments at least some of the operations performed by these modules may be combined in to fewer blocks. For example, in some cases, object module 603 may be combined with display module 602 and/or with interface board module 604. Conversely, any given one of modules 601-605 may be implemented such that its operations are divided among two or more logical blocks. Although shown with a particular configuration, in other embodiments these various modules or blocks may be rearranged in other suitable ways.

FIG. 7 is a flowchart of an example of method 700 of operating tracking system 300 in hybrid playfield 104. In some embodiments, method 700 may be performed, at least in part, by computing system 401 executing software 600 in cooperation with interface board 402 and tracking system 300. At block 701, method 700 may include determining that a pinball game has started or is about to start. At block 702, method 700 may include identifying a transducer configuration to be used by tracking system 300. As previously noted, different transducer configurations may be used in a single machine 100, and, depending upon the specific game being played, a particular configuration may be more suitable for tracking certain physical objects.

At block 703, method 700 may include selecting a scanning pattern to be used during a tracking operation. For example, in the configuration shown in FIG. 3, the selected scanning pattern assigns detector elements 322, 324, 326, 328, and 330 to receive signals 318, 317, 314, 315, and 316 emitted by transmitter element 307, respectively. In some cases, a scanning pattern may be such that each of transmitter elements 301, 303, 305, 307, 309, 311, 313, 319, 321, 323, 325, 327, 329, and 331 is activated in rapid succession and in this order. In other cases, a transmitter element of first transducer array 300A may be activated followed by a transmitter element of second transducer array 300B in an alternating manner (e.g., 301, 319, 303, 321, and so on). In yet other cases, two or more transmitter elements may be activated simultaneously.

In some implementations, more or fewer detectors may be assigned to receive more or fewer signals from a given transmitter element at a given time. Moreover, the position of the transmitter element may dictate how many and which detector elements are assigned for a given scanning pattern. For instance, using the pattern illustrated in FIG. 3, when transmitter 301 is active, only detectors 320 and 322 (i.e., two detectors) may be configured to receive its signals. When transmitter 303 is active, detectors 320, 322, 324, and 326 (i.e., four detectors) may be configured to receive its signals. And, when transmitter 305 is active, detectors 320, 322, 324, 326, and 328 (i.e., five detectors) may be configured to receive its signals. In other implementations, however, a 1:1 relationship between transducer elements may be established such that a given detector is assigned to a single corresponding transmitter and vice-versa.

More generally, any suitable scanning pattern may be selected that creates a mesh such that, when a physical object such as ball 202 is traveling between transducer arrays 300A and 300B therefore blocking the line-of-sight between a transmitter and an assigned detector, tracking system 300 and/or computing system 401 is capable of determining the position, speed, and/or direction of movement of the physical object. In various embodiments, signals are transmitted and received between transducer arrays 300A and 300B at angles other than a right angle.

At block 704, method 700 may execute scanning operation(s) using the identified configuration and/or selected pattern and, at block 705, method 700 may store results of those operation(s). At block 706, method 700 may determine whether the game has ended. If not, control returns to block 704. Otherwise, tracking may end at block 707.

It should be noted that, in some embodiments, one or more of the operations described above may be conducted independently of whether a game is in progress. For example, in some cases, tracking may be active for purposes of touchscreen interactions when pinball machine 100 is in "service mode" (e.g., testing, debugging, etc.). More generally, electronic display 200 in conjunction with tracking system 300 may allow an operator to interface with aspects of computing system 401 at any time, for instance, to change the machine's configuration, select a new pinball game, test one or more of the machine's components, etc.

FIG. 8 is a flowchart of an example of method 800 of obtaining an object's position in hybrid playfield 104 using tracking system 300 according to some embodiments. Again, in some embodiments, method 800 may be performed, at least in part, by computing system 401 executing software 600 in cooperation with interface board 402 and tracking system 300. At block 801, method 800 may include initializing or setting an integer or counter n to a zero value and, at block 802, method 800 may include activating transmitter element n.

At block 803, method 800 may include determining whether there is a direct line-of-sight reception at all of the one or more assigned detector elements. If so, then block 806 increments the value of n and control returns to block 802, where a subsequent transmitter element following the selected scanning pattern is selected. Otherwise, at block 804, method 800 may include identifying which of the assigned detector elements had its light-of-sight blocked by a physical object. Then, at block 805, method 800 may include calculating the physical object's position based, at least in part, upon the result of block 804.

To illustrate operations 802-806, consider the following example. Assume, hypothetically, that ball 202 shown in FIG. 3 is now at a position such that it blocks the light-of-sight of detector 330 when transmitter 307 is activated. Because the relative position between arrays 300A and 300B is known, it may be inferred that, at the time of the scan, ball 202 was located somewhere along the path of signal 316. As n is incremented, subsequent transmitter elements are activated and other detectors may have their light-of-sight blocked, such that the position of ball 202 may be determined to be at the intersection(s) of two or more of these signals.

In some embodiments, the frequency of the scanning operation may be such that a sufficient number of transmitters are activated in series to resolve the position of ball 202 prior to ball 202 having moved to another position that is significantly distant from the resolved position. For example, in some cases, the position of ball 202 may be identified with a margin of error no larger than the diameter of ball 202.

Computing system 401, interface board 402, and/or object module 403 may also maintain a historical record of the positions of ball 202 at different times. Therefore, computing system 401 and/or interface board 402 may be configured to calculate a speed of ball 202 and/or a direction of movement of ball 202 based on that historical record. In some cases, computing system 401 and/or interface board 402 may be further configured to predict the position of ball 202 at a future time based upon its present and/or past behavior.

Physical Objects Causing Changes in Virtual Objects

In some embodiments, hybrid playfield 104 may provide the illusion that one or more physical objects, such as one or more balls 202, interact with one or more virtual objects, such as one or more images rendered on electronic display 200. This may take place, for example, when a physical object is detected via tracking system 300 to be moving over an area of hybrid playfield 104 containing the virtual objects. In other examples, the interaction with virtual objects may be triggered upon detection, via tracking system 300, that a physical object has a certain speed or moves in a particular direction (e.g., toward a virtual object) across hybrid playfield 104.

In some cases, interactions between a physical object and a first virtual object may cause that first virtual object to move, change its shape, disappear, etc. on electronic display 200. The same interactions between the physical object and the first virtual object may also cause a second virtual object to move, change its shape, appear, disappear, etc. on electronic display 200. Other game-related interactions resulting from the interaction of physical and virtual objects in hybrid playfield 104 may include, but are not limited to, game scores being adjusted, sound and video devices being played, lamps being turned on and off individually or in pre-defined sequences, etc.

Figure 9:
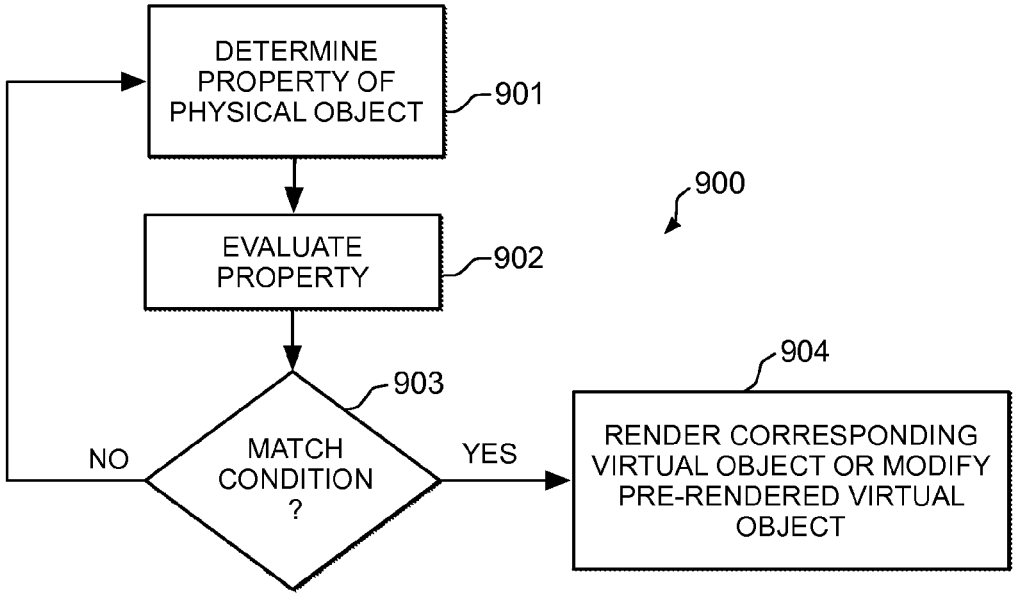
FIG. 9 is a flowchart of an example of a method of enabling physical object(s) to interact with virtual object(s) in a hybrid playfield according to some embodiments.

FIG. 9 is a flowchart of an example of a method of enabling physical object(s) to interact with virtual object(s) in hybrid playfield 104. In some embodiments, method 900 may be performed, at least in part, by computing system 401 executing software 600 in cooperation with electronic display 200, interface board 402, and tracking system 300. At block 901, method 900 may include determining a property of a physical object (e.g., ball 202). For instance, in some cases, method 900 may include determining a position of the physical object on hybrid playfield 104, a speed of the physical object over hybrid playfield 104, and/or a direction of movement of the physical object across hybrid playfield 104.

At block 902, method 900 may evaluate the property. At block 903, if the property does not match any preselected conditions, control returns to block 901. Otherwise, control passes to block 904, where method 900 may include rendering a corresponding virtual object on display 200 or modifying a previously rendered virtual object. The conditions referred to in block 903 may include any programmable statement(s) that, when executed, give the appearance that the physical object's property or behavior has affected one or more virtual objects.

In some implementations, a player may indirectly manipulate the physical object described in block 901. For example, when the physical object is ball 202, the player may briefly hit that object with another physical object, such as flippers 207A and 207B. Manipulation of flippers 207A and 207B may itself be indirect, for example, via side control(s) 107. After being hit, ball 202 may travel along playfield freely and outside of the user's control.

It should be noted that determination of a property of a physical object in block 901 is different from the detection of a player's own finger or stylus on a capacitive touchscreen of a tablet computer, which the user directly controls. For example, in the tablet scenario, if the touchscreen does not respond as expected by the user, the user may simply repeat his or her gesture; whereas in the case of a pinball machine, because ball 202 moves on its own, it would be much more difficult to make ball 202 repeat the exact same trajectory at a later time and, in any event, a game opportunity would be lost.

Figure 10A:
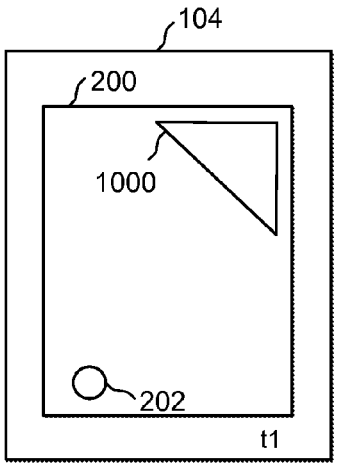
FIGS. 10A-H are diagrams illustrating examples of physical object(s) initiating interaction(s) with virtual object(s) according to some embodiments.
Figure 10B:
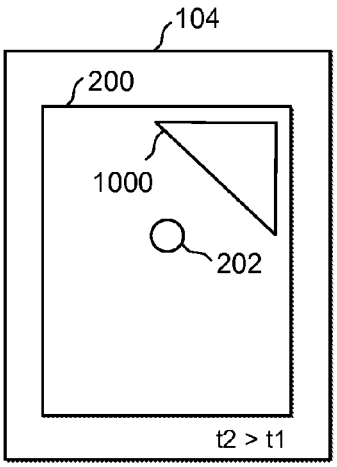
Figure 10C:
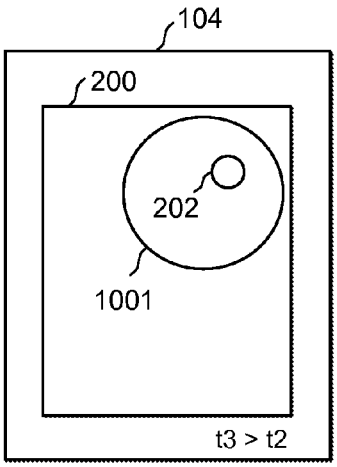

FIGS. 10A-H are diagrams illustrating examples of physical object(s) initiating interaction(s) with virtual object(s) according to some embodiments. Particularly, FIG. 10A shows ball 202 (i.e., a physical object) at t=t1 traveling along hybrid playfield 104 while electronic display 200 renders virtual object 1000 in the shape of a triangle. At FIG. 10B, ball 202 has moved closer to virtual object 1000 at t=t2 (t2>t1), but has not yet reached it. Then, at FIG. 10C, ball 202 has reached the position of virtual object 1000 on electronic display 200 at t=t3 (t3>t2), thus causing virtual element 1000 to change into virtual element 1001, which now has a circular shape. Referring back to FIG. 9, the predetermined condition expressed in block 903 in this case may be such as:

if position of <ball 202>==position of <virtual object 1000>;
then change <virtual object 1000> into <virtual object 1001>

Thus, in this case, the operations of method 900 may help create a visual impression that ball 202 has physically interacted with virtual object 1000 upon reaching its location in hybrid playfield 104 and effectively changed the virtual object's shape and/or other visual characteristic.

Figure 10D:
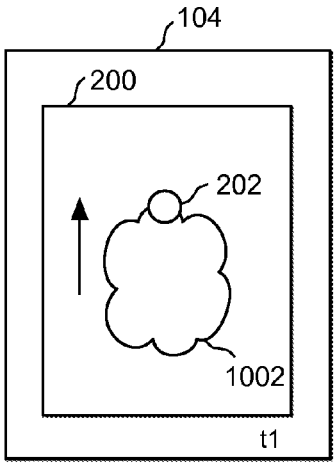
Figure 10E:
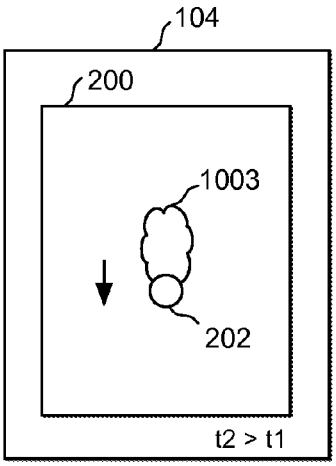

As another example, FIG. 10D illustrates ball 202 traveling upwards (shown by an arrow pointing up) across hybrid playfield 104 at t=t1 (e.g., after being hit by flipper(s) 207A or 207B), thus acquiring a first speed. FIG. 10E shows ball 202 traveling in a downwards direction (shown by an arrow pointing down) at t=t2 (t2>t1) with a second speed which, in this case, is smaller than the first speed. Accordingly, in FIG. 10D, virtual object 1002 represents a graphical image or visual animation of fire or smoke following ball 202 and having a first size proportional to the first speed, whereas in FIG. 10E virtual object 1003 represents the fire or smoke with a second size proportional to the second speed, such that the first size is larger than the second size.

Figure 10F:
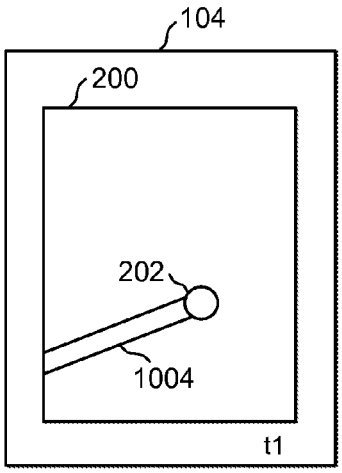
Figure 10G:
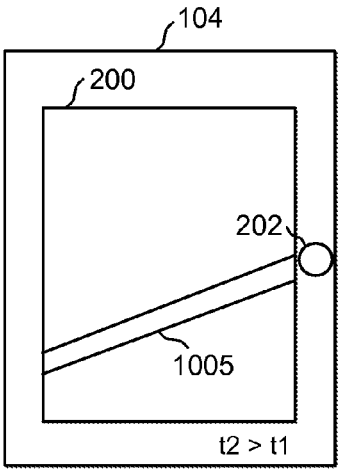
Figure 10H:
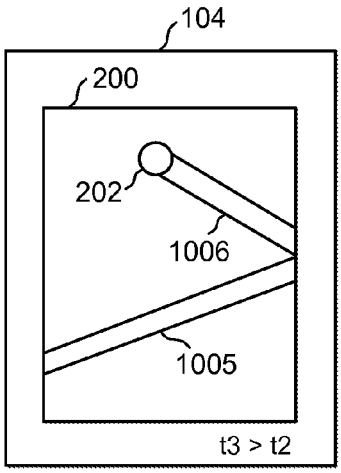

As yet another example, FIG. 10F shows ball 202 traveling across hybrid playfield 104 at t=t1 in a first direction thus leaving trail or mark 1004. FIG. 10G shows ball 202 leaving the surface of electronic display 200 and reaching the boundary of hybrid playfield 104 at t=t2 (t2>t1), from which ball 202 bounces back. As such, trail or mark 1005 is longer than trail or mark 1004. Then, FIG. 10H shows ball 202 traveling across hybrid playfield 104 in a second direction at t=t3 (t3>t2), thus creating trail or 1006 in the second direction.

It should be noted that the examples of FIGS. 10A-H are provided for sake of illustration. More generally, any virtual object(s) rendered on electronic display 200 may be affected by any physical property (or combination of physical properties) of any physical object(s) within hybrid playfield 104 in any suitable manner. In the examples above, the physical properties used are position, speed, and direction; although in other embodiments, other physical properties may be used such as shape, size, sound, color, etc. In various implementations, the type of virtual object and how that object is affected by the behavior of a physical object normally depends upon the specific game being played, and as such may vary from game to game.

Moreover, in some embodiments, the behavior of a physical object may be detected other than through tracking system 300. For instance, ball 202 may physically reach trigger element 205, and electronic display 200 may in response render an animation such that it appears that a first virtual object such as an image of a laser beam or projectile is shot by trigger element 205 into hybrid playfield 104. The first virtual object may then interact with other virtual objects on electronic display 200; for example, the virtual laser beam or projectile may cause a second virtual object (e.g., an image of a building, etc.) to explode on electronic display 200.

Virtual Objects Causing Changes in Physical Objects

In some embodiments, hybrid playfield 104 may present the illusion that one or more virtual objects, such as one or more images rendered on electronic display 200, interact with one or more physical objects, for example, when the virtual object exhibits a predetermined behavior. For instance, when a virtual element is animated on display 200 in a particular way, it may trigger a software-initiated modification to an aspect of a physical object.

Figure 11:
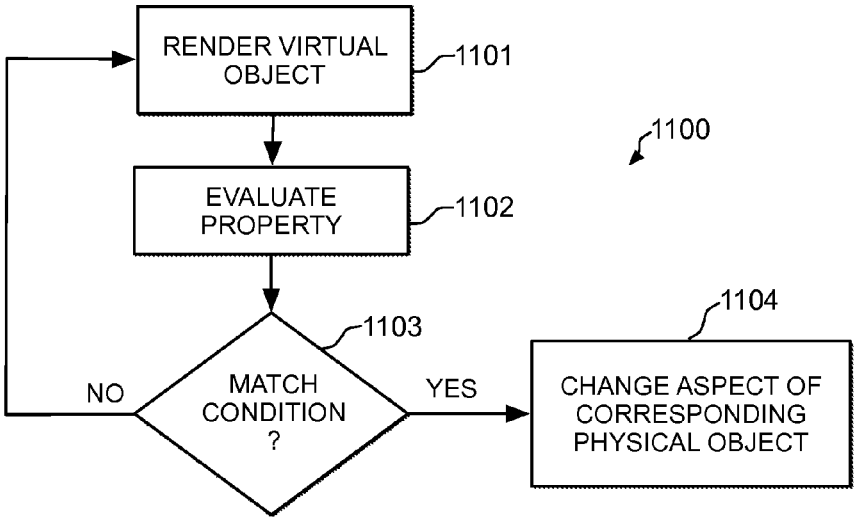
FIG. 11 is a flowchart of an example of a method of enabling virtual object(s) to interact with physical object(s) in a hybrid playfield according to some embodiments.

In that regard, FIG. 11 is a flowchart of an example of a method of enabling virtual object(s) to interact with physical object(s) in hybrid playfield 104. In some implementations, method 1100 may be performed, at least in part, by computing system 401 executing software 600 in cooperation with electronic display 200, interface board 402, and tracking system 300. At block 1101, method 1100 may include rendering a virtual object on electronic display 200. At block 1102, method 1100 may include evaluating a property of the virtual object. At block 1103, if the property does not match a programmed condition, control returns to block 1101. Otherwise, at block 1104, method 1100 may include changing an aspect of a corresponding physical object.

Figure 12A:
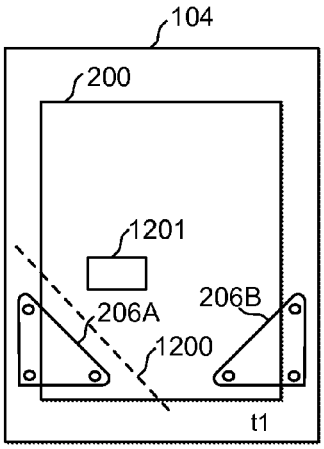
FIGS. 12A-F are diagrams illustrating examples of virtual object(s) initiating interaction(s) with physical object(s) according to some embodiments.
Figure 12B:
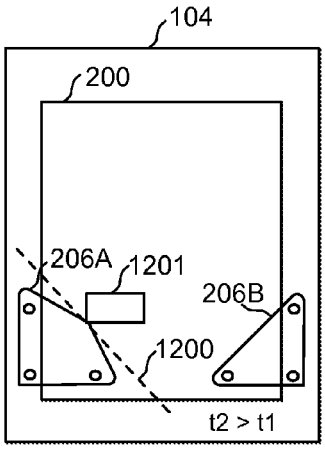
Figure 12C:
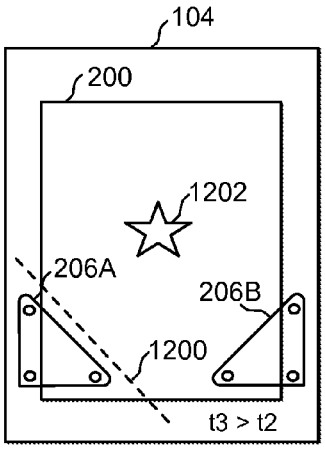

FIGS. 12A-F are diagrams illustrating examples of virtual object(s) initiating interaction(s) with physical object(s) according to some embodiments. In FIG. 12A, virtual object 1201 is animated on display 200 to move at t=t1 toward slingshot 206A, a physical object. FIG. 12B shows virtual object 1201 reaching threshold line 1200 at t=t2 (t2>t1), thus triggering a deformation of slingshot 206A such that, to an observer, it appears as if slingshot 206A is reacting physically to the behavior of virtual object 1201 on display 200. The deformation of slingshot 206A is a physical response initiated by software because, in this case, virtual object 1201 is in a specific position relative to slingshot 206A. In an embodiment, the shape of slingshot 206A may be controlled by a solenoid mechanism that, when activated by software, pushes against a side of slingshot 206A, thus causing it to mechanically expand. Then, FIG. 12C shows slingshot 206A returning to its original shape at t=t3 (t3>t2), and electronic display 200 changes the shape of virtual element 1201 into virtual element 1202, which now travels away from slingshot 206A on display 200 as if it had physically bounced off of slingshot 206A and now appears to be moving further away from slingshot 206A.

By drawing virtual element 1202 such that it appears to be moving away from slingshot 206A, this technique may cause observer, such as the player, to believe that a virtual element 1201 (i.e., a graphical image) actually represents a physical object that interacted mechanically or physically with another (but actual) physical object (i.e., slingshot 206A). More specifically, it may appear as if virtual element 1201 actually collided with slingshot 206A, causing a solenoid mechanism to activate, in turn causing slingshot 206A to "push" virtual element 1202 away from it.

Figure 12D:
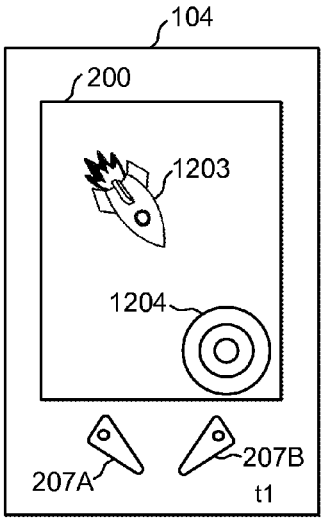
Figure 12E:
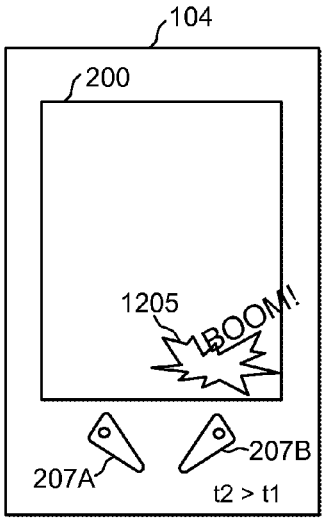
Figure 12F:
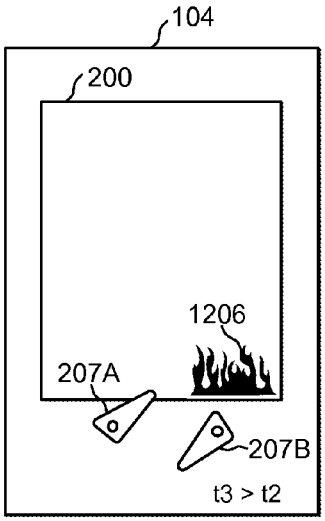

In other embodiments, a virtual element does not need to appear to come into contact with a physical object, but it may still affect the operation of that physical object. An example of this technique is shown in FIGS. 12D-E. In FIG. 12D, a first virtual object 1203 (a rendering of a missile) is animated to move toward a second virtual element 1204 (a rendering of a target) on electronic display 200 at t=t1. FIG. 12E shows that first virtual object 1203 and second virtual object 1204 have been replaced by third virtual object 1205 (a rendering of an explosion) upon first virtual object 1203's reaching of second virtual object 1204 at t=t2 (t2>t1). At this moment, operation of flipper 207B (i.e., a physical object) may be changed such that, when a player activates side control(s) 107, only flipper 207A is capable of moving upwards while flipper 207B is stuck in a down position as a result of the collision between virtual element 1203 and virtual element 1204. In some cases, a fourth virtual object 1206 (e.g., a rendering of fire or smoke) may indicate that flipper 207B is not operational such that, when virtual object 1206 disappears of fades from electronic display 200, flipper 207B returns to its normal operation under control of the player.

In other words, when the first virtual object reaches a specific point on electronic display 200, it may cause a specific, predetermined reaction in a physical object, such as one or more flippers 207A and 207B. An example of such a reaction may be to cause the one or more of flippers 207A and 207B to flip, as if the missile pressed a "virtual flipper" button. Another reaction may be causing flippers 207A and 207B to "lose power," such that when the player next activates the flippers, they do not have as strong a pulse as they did prior to the missile reaching the specific location on electronic display 200. Because the length of the flipper pulse, and therefore the power of the pulse, is controlled by software, control engine 601 may effectively weaken flippers 207A and/or 207B in response to missile 1203 reaching the specific location on the electronic display 200. This technique may make it appear that the graphical, virtual object (i.e., missile 1203) represented a physical element, such as a real missile, and was therefore capable of affecting physical object (i.e., flippers 207A and 207B).

Similarly as explained above, here it should also be noted that the examples of FIGS. 12A-F are provided for sake of illustration. More generally, any physical object(s) in hybrid playfield 104 may have its propert(ies) modified in response to the behavior of one or more virtual object(s). Properties of the physical objects that may be subject to being changed include its shape, operation, color, sound, etc. Again, in various implementations, the type of physical object and how that object is affected by the behavior of a virtual object normally depends upon the specific game being played, and as such may vary from game to game.

Physical objects that can be affected by virtual objects include, but are not limited to, lamps, light emitting diodes (LEDs), magnets, motors, and solenoid assemblies, all of which may be found on pinball machine 100. Virtual objects that may interact with physical objects include, but are not limited to, shapes or combination of shapes drawn on a display element, projected from a projection device, or otherwise displayed in a way that they appear to be part of or on pinball machine 100. The location of virtual objects can be anywhere on machine 100, oftentimes, but not always, close to the physical objects with which they appear to interact. In the example above where the missile is described to press a virtual flipper button, the spatial proximity of the missile and virtual button relative to the flippers is not relevant. As such, the graphical elements (missile and virtual button) can be located anywhere on electronic display 200.

Multiple-Game Pinball Machine

In some embodiments, pinball machines 100 such as described in FIG. 1 may be configured to load, store, and/or run multiple software applications. A software application may, upon execution, present a player with a full gaming experience on machine 100. Such a gaming experience is commonly referred to as a "pinball game" or simply "game." Each game may include program instructions and/or logic that causes it to: start running at a player's request, launch one or more balls into play, and enable the player's interaction with the ball (e.g., by allowing the player to control the flippers, and present play objectives to the players). Play objectives may include goals that the player may attempt to achieve during the course of gameplay, including, but not limited to, hitting specific targets or shots, sometimes in specific sequences.

Each game may have a defined beginning and end. The beginning of a game usually includes the resetting of specific game objects and objectives and launching a ball into play. The ball may be launched into play either automatically when the game begins, or in response to an action by the player, such as the pressing of a button. The end of a game may include the conclusion of a set of gameplay objectives. This conclusion may occur either when the player successfully achieves the objectives or when the player's last ball goes out of play, either by draining or by some other event on the pinball machine. The end of a game may also include information presented to the player about the accomplishments that were achieved during gameplay and/or about other information indicating the game has ended. In some cases, the information may be presented as audio and/or video and/or even as tactile feedback provided through mechanisms on the machine.

As previously noted, pinball machine 100 may comprise computing device 401, which in turn includes static or dynamic computer memory, typically a non-volatile flash-based device or a computer hard drive, onto which multiple software applications may be loaded and/or stored. Generally speaking, there is no limit to the number of software applications that may be loaded and/or stored other than those imposed by the physical size of the storage devices used for software application storage.

In another embodiment, pinball machine 100 may be capable of connecting to a computer network over which software applications may be loaded, stored, and/or played. Therefore, software applications available on the network, whether on a remote software application server or on another pinball machine on the network, may be loaded and stored so that they can be played immediately or at some time in the future, whether or not the pinball machine remains connected to the network. Alternatively, a software application may be be run directly from the network, whereby the software application is not stored locally but rather loaded and run while the pinball machine stays connected to the network. In this case, the software application may not be stored on the pinball machine and therefore would be unavailable when the machine is not connected to the network.

In yet another embodiment, the pinball machine may be capable of running a game directly from locally attached media, such as a CD or DVD. In this embodiment, a user can load one media device, such as a CD or DVD, to play one software application and later load another media device, such as another CD or a DVD, to play another software application. Alternatively, one media element, such as a CD or DVD, may contain multiple software applications from which the player can choose which one to load and play.

Pinball machine 100 may also include a software Operating System (OS) that presents the user with a way to select the desired software application. In an embodiment, the operating system, which is a layer of software that is running when no software application is active and oftentimes even while a software application is active, shows a set of choices on a display (e.g., electronic display 200). Each choice may include a menu of additional choices or the name of available software applications. The OS may provide the user with a suitable way of navigating through the choices, oftentimes via button presses, and selecting desired items, such as additional menus to be navigated or the software application to be executed. The OS may therefore provide a way for the user to select a software application to play.

As described before, a list of software applications may include software applications already stored locally on the machine and/or software applications that are available from remote devices accessible via a computer network to which the pinball machine is connected and/or software applications stored on media devices, such as CDs, DVDs, or any other type of media capable of storing one or more software applications.

The OS may also provide ways of loading and storing additional software applications. In an embodiment, the OS may provide a set of options the user can select via buttons. One such option may be to load a list of available software applications from the network. The OS may then allow a user to select one or more of the available software applications, and the OS may load the desired software applications from the network and store them locally. In another embodiment, the OS may provide one or more mechanisms to load additional software applications from locally attached media, such as a CD or DVD, or from some other locally attached device, such as a computer or storage device attached through USB, BLUETOOTH, or some other communications interface.

Embodiments of pinball machine 100, as described above, may present the user with a list of software applications. The presentation of the list may take many forms, including but not limit to menus, folders, a single long list, and/or graphical icons or screens. The user may select and play the same software application every time he wants to play a game, or he can select and play a different software application each time.

In multi-player games, whereby software tracks the gameplay of multiple players simultaneously or sequentially, each player may optionally choose the same software application as those chosen by other players or a completely different software application. In this manner, multiple players may play different software applications at the same time on the same machine. In some embodiments this may involve each player taking turns playing until one specific portion of their game ends, such as a ball draining, while in other embodiments, players may be physically interacting with the machine and playing their chosen software applications simultaneously.

When including one or more of the elements described above, pinball machine 100 may be considered to be a pinball platform, whereby the platform is capable of loading and/or storing and/or executing many different software applications. The software applications may all be related to a specific theme or subject matter, or they may each be completely different and unique. Because the number of software applications the pinball machine stores and/or executes may continue to grow over time, it is significantly less likely, as compared to a traditional pinball machine that presents just one or two different software applications to a player, to become boring to the player.

Figure 13:
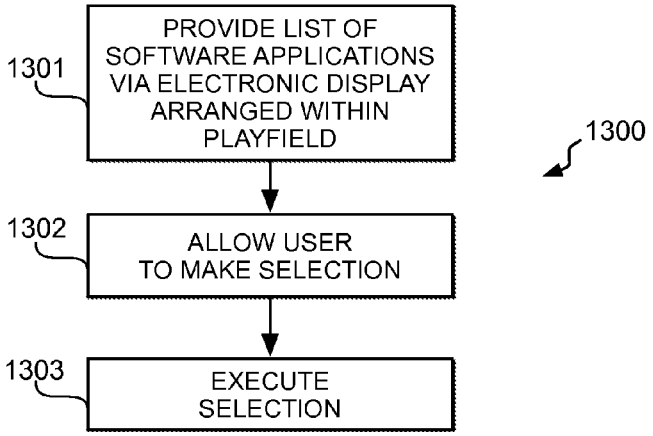
FIG. 13 is a flowchart of an example of a method of providing one or more software applications in a pinball machine according to some embodiments.

FIG. 13 is a flowchart of an example of method 1300 of providing one or more software applications in pinball machine 100 according to some embodiments. At block 1301, method 1300 includes providing a list of software applications (e.g., pinball games) via a display or screen (e.g., electronic display 200) arranged within a playfield (e.g., hybrid playfield 104). At block 1302, method 1300 may include allowing a player or user to make a software selection (e.g., using side control(s) 107). Then, at block 1303, method 1300 may include executing the software selection (e.g., starting a selected game).

Playfield Reducer

In some embodiments, pinball machine 100 such as described in FIG. 1 may include a playfield reducer. A playfield reducer is a mechanism configured to reduce the effective size of a playfield by creating an effective barrier that blocks, from one edge of the playfield to an opposite edge, an entire portion of the playfield. In some implementations, a playfield reducer may naturally rest in an unblocking configuration such that, when activated, it blocks a first playfield portion from a second playfield portion. In other implementations, a playfield reducer may naturally rest in a blocking configuration such that, when activated, it connects a first playfield portion from a second playfield portion.

Generally speaking, a playfield reducer is said to "block" a first playfield portion from a second playfield portion when a pinball cannot travel freely between the two portions during a game. In some cases, even when the pinball can travel between the two portions, the playfield reducer prevents the pinball from interacting with other pinball components positioned behind the playfield reducer itself. For example, if the playfield reducer is a barrier located in the second playfield portion, although a pinball can enter the second playfield portion prior to hitting the barrier, the barrier then blocks the pinball from interacting with other elements of the second playfield portion (i.e., objects positioned behind the barrier).

Figure 14A:
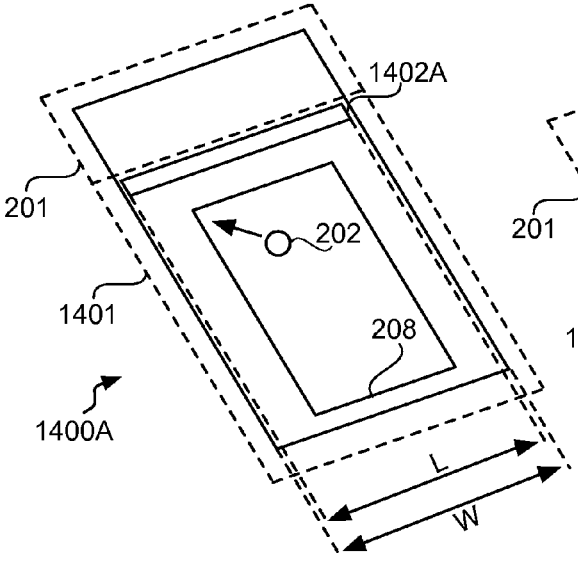
FIGS. 14A and 14B are diagrams illustrating an example of a playfield reducer configured as a barrier element according to some embodiments.

FIG. 14A is a diagram of an example of a playfield reducer configured as a barrier according to some embodiments. As illustrated, playfield 1400A includes main playfield portion 1401 and modular portion 201. (Modular portions are discussed in more detail below.) Main playfield portion 1401 includes playfield reducer 1402, which in this instance is in a natural position "A" such that its top surface is aligned with the surface of playfield 1400A, and therefore does not interfere with the movement of pinball 202. In this configuration, pinball 202 is free to travel between portions 1401 and 201 during a pinball game—for example, when hit by flippers 207A/B—without regard for pinball barrier 1402A.

Figure 14B:
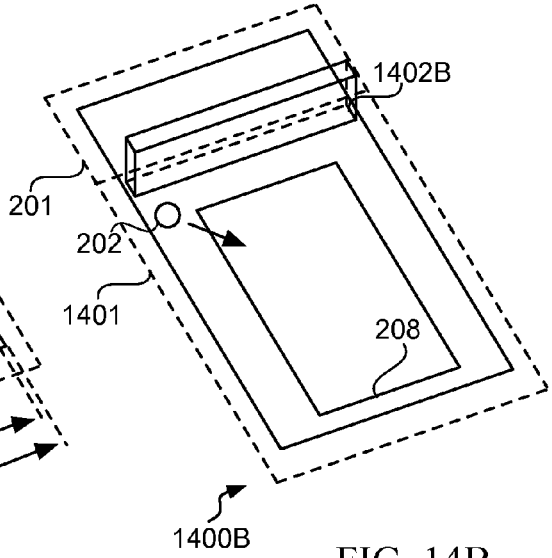

In FIG. 14B, playfield reducer 1402 has been activated and assumes a "B" configuration; that is, its top surface is above the surface of playfield 1400A and therefore impedes pinball 202 from traveling from main playfield portion 1401 to modular portion 201. In this example, the width (W) of playfield 1401 is longer than the length (L) of playfield barrier 1402. Consequently, playfield barrier 1402 does not reach the opposite, outermost lateral edges of playfield 1400. However, assuming that the diameter of pinball 202 is given by D, so long as $(W-L)/2>D$, then barrier 1402 is still capable of effectively stopping pinball 202 from crossing over between main portion 1401 and modular portion 201.

Here it should be noted that traditional barriers have been designed to block only a small portion of a playfield, and therefore do not extend from one outermost edge of the playfield to the other. In contrast, a playfield reducer, as described herein, is configured to ensure that pinball 202 cannot move beyond playfield barrier 1402 at any point between the two lateral edges of the playfield. Moreover, in the foregoing example, main playfield portion 1401 may be similar to hybrid playfield 104 described above, and may include electronic display 200. Accordingly, even when playfield barrier 1402 is activated, a game or portion thereof may still be played using only main playfield portion 1401, for example, by allowing physical objects (e.g., pinball 202) to interact with virtual objects rendered upon display 200 and vice-versa.

In some embodiments, a playfield reducer may be located in main playfield portion 1401, in modular playfield portion 201, or both. Also, a playfield reducer may include mixed elements or mechanisms. For example, returning to FIG. 14A, playfield reducer 1401A may be physically divided into distinct components (e.g., smaller walls disposed side-by-side), and each distinct component may be activated together to raise a barrier in FIG. 14B. Additionally or alternatively, the playfield reducer may include different types of components. For example, a wall or barrier portion may cause pinball 202 to bounce back into main playfield portion 1401, whereas a hole portion may capture pinball 202 and return it via a ramp, shoot, or any other suitable return path.

Figure 15A:
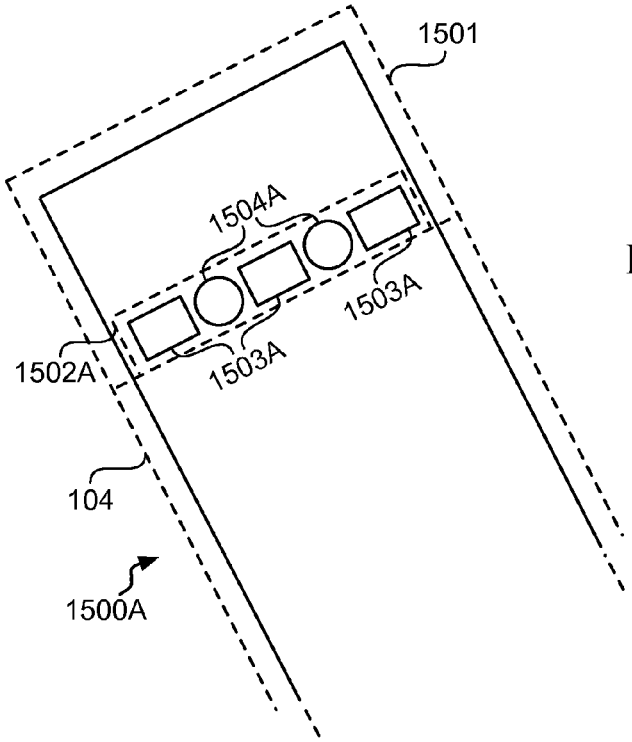
FIGS. 15A and 15B are diagrams illustrating an example of a mixed-element playfield reducer according to some embodiments.

FIG. 15A is a diagram of an example of a mixed-element playfield reducer according to some embodiments. As illustrated, playfield 1500A includes main playfield portion 104 and modular portion 1501. Modular portion 1501 includes playfield reducer 1502, which is in a natural position "A" such that its top surface is aligned with the surface of playfield 104, and therefore does not interfere with a pinball (not shown). In this configuration, a pinball would be free to travel between portions 104 and 1501 during a pinball game.

In contrast with the embodiment shown in FIGS. 14A and 14B, here playfield reducer 1502 includes mixed reducer elements 1503A and 1504A. In particular, targets 1503A are interspersed by holes 1504A. In order for a pinball to be able to cross over reducer 1502, targets 1503A are lowered into playfield 1500A, and holes 1504A are covered.

Figure 15B:
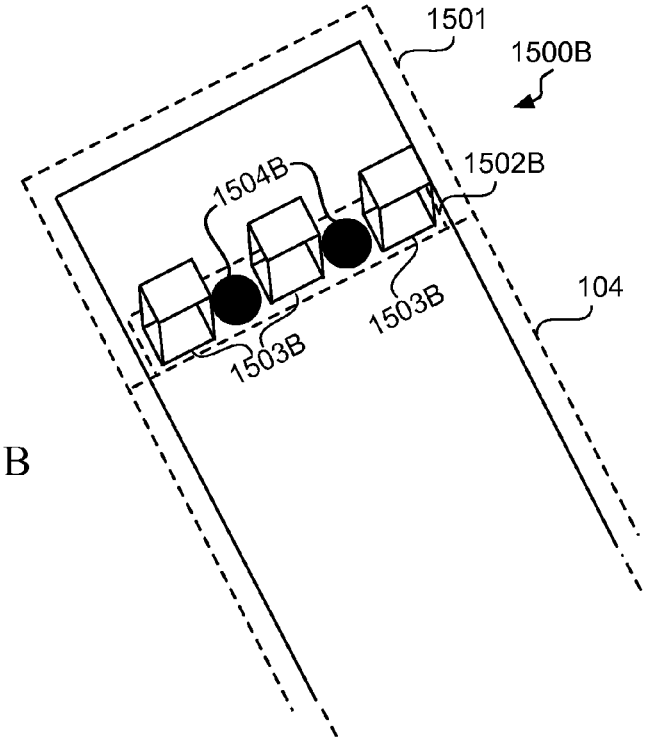

As shown in FIG. 15B, playfield reducer 1502 has been activated. Accordingly, targets 1503B are raised above the surface of playfield 1500A, and holes 15048 are uncovered. For example, in some implementations, one or more lids may be configured to slide in a direction parallel to playfield 104, thus opening holes 15046 such that a pinball traveling toward holes 1504B is trapped within them; and in some cases redirected to another area of playfield 104. In other implementations, one or more lids may open with a flapping movement; the lid itself creating an additional barrier such that a pinball, upon hitting the lid, falls into holes 1504B. In yet other implementations, the lid can open in a downward direction.

In some embodiments, the various components of playfield reducer 1502 may be arranged non-linearly, and can be configured in any way that keeps an object from reaching any position, from a first playfield edge to a second playfield edge, beyond at least one specific point of playfield reducer 1502. Additionally or alternatively, one or more components may be arranged in a main playfield portion, and one or more other components may be arranged in a modular portion.

Figure 16:
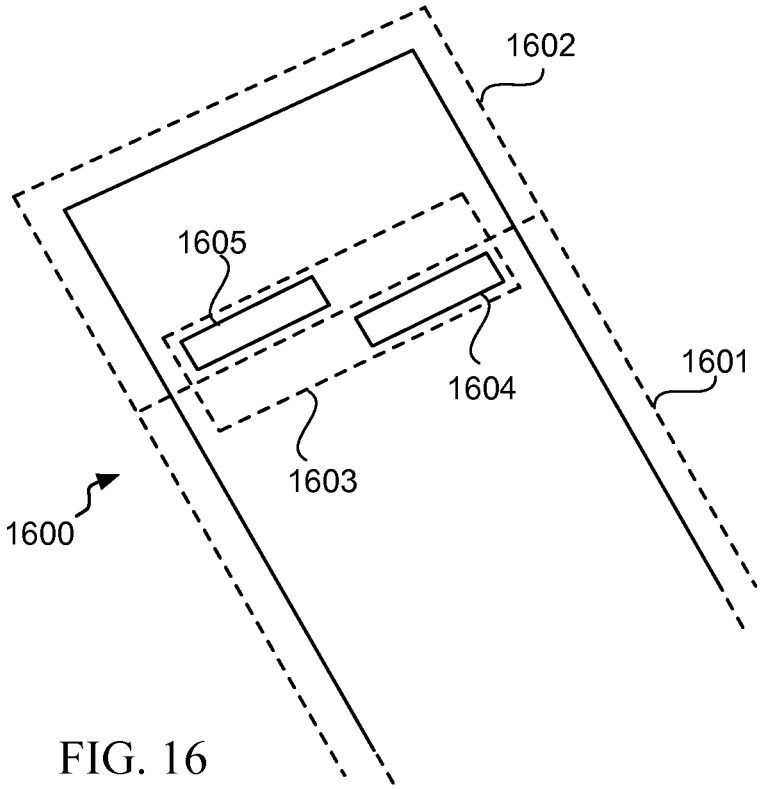
FIG. 16 is a diagram illustrating an example of a split playfield reducer according to some embodiments.

In that regard, FIG. 16 shows an example of a split playfield reducer according to some embodiments. As illustrated, playfield reducer 1603 divides playfield 1600 into a first portion 1601 and a second portion 1602. A first part 1604 of playfield reducer 1603 is disposed in first playfield portion 1601 and a second part 1605 of playfield reducer 1603 is disposed in second playfield portion 1602. Moreover, the first and second playfield portions 1601 and 1602 may be capable of being decoupled from each other. In some embodiments, activation and deactivation of the entire playfield reducer 1603 may be coordinated such that it happens synchronously during a pinball game.

Figure 17:
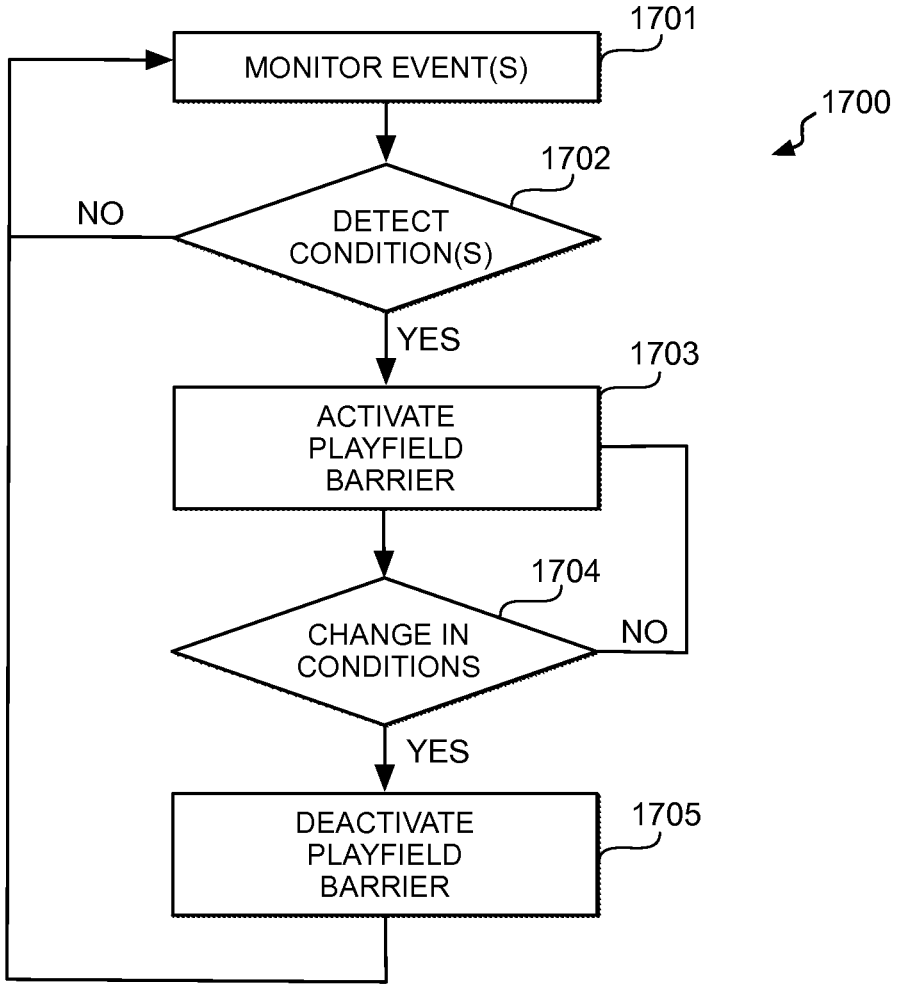
FIG. 17 is a flowchart of an example of a method of operating a playfield reducer according to some embodiments.

FIG. 17 is a flowchart of an example of a method of operating a playfield reducer. In some embodiments, method 1700 may be performed, at least in part, by computing system 401 executing software 600 in cooperation with electronic display 200, interface board 402, and tracking system 300. At block 1701, method 1700 may include monitoring or attempting detection of one or more events. In some cases, the event may be a software-based event that takes place during a pinball game, such as the reaching of a predetermined score, the failing to reach the predetermined score, the reaching of a predetermined game stage, the passage of a predetermined amount of time, and/or user selection. In other cases, the event may be a physical event that takes place, for example, when a physical object (e.g., pinball, flipper, slingshot, kicker, bumper, target, plunger, hole, saucer, spinner, gate, switch, stopper, ramp, magnet, etc.) assumes one or more physical properties (e.g., position, speed, direction, etc.).

At block 1702, method 1700 may include evaluating whether one or more event conditions are met. For example, a game rule may be such that, if a player has reaches a given score, a playfield reducer is activated. Additionally or alternatively, a rule may provide that upon a pinball hitting a particular target, the playfield reducer is activated. If the conditions are not met, control returns to block 1701. Otherwise, at block 1703, method 1700 includes activating a playfield reducer.

In some cases, activating the playfield reducer may include raising one or more barrier elements located in a main playfield portion and/or in a modular portion of the playfield. Additionally or alternatively, activating the playfield reducer may include opening in one or more hole elements located in a main playfield portion and/or in a modular portion of the playfield.

At block 1704, method 1700 may include evaluating whether there has been a change in conditions. For example, a software timer may have expired, the player may have scored a predetermined number of points, and/or the pinball may have again hit the same (or another) target. If not, control returns to block 1703. Otherwise, at block 1705, method 1700 includes deactivating the playfield barrier. In some cases, deactivating the playfield reducer may include lowering barrier element(s) and/or closing hole element(s).

In the previous example, it is assumed that a playfield reducer, when in its natural or resting state, allows a pinball to travel between different playfield portions. As previously noted, however, in some cases a playfield reducer may be configured to block a pinball from travelling between different playfield portions in its resting or natural state. In those cases, activating the playfield reducer includes unblocking the pinball to that it has access to the different playfield portions.

Although the examples herein discuss the use of barriers or targets and holes and reducer elements, it should be noted that different types of reducer elements may be used, and that those elements may be used any suitable configuration. For example, in cases where a pinball is made of a metallic material, a playfield reducer may include a magnet or electromagnet configured to "catch" the pinball when activated and "release" the pinball when deactivated (or vice versa).

In sum, the various playfield reducers described here may be configured to restrict the movement of one or more objects, at specific times during the play of a game, from traveling beyond a barrier. This effectively creates a smaller size playfield, to which the movement of the object(s) is confined. In some cases, such playfield reducers may be used for challenging a player's reaction times by reducing the distance an object can travel, creating a smaller region in which an object can interact with other mechanisms or objects on the playfield, etc.

Modular Playfields

Traditionally, pinball machines have used a monolithic playfield. In those machines there is one main playfield, sometimes subdivided into one or more smaller areas, but nonetheless lacking interchangeable or swappable playfield modules. The playfield is commonly made from a large sheet of plywood, typically Baltic birch or some other hardwood, though the material that comprises the playfield can be anything on which a pinball can roll or to which other components (e.g., targets, barriers, switches, lights, ramps, etc.) may be attached. Such playfields may have a multitude of holes down through which one or more pinballs can fall, or up through which one or more pinballs may be propelled. The types and varieties of components attached to playfields are numerous and combine to define a layout that determines how one or more balls will move on the machine and provides visual, audio, and/or tactile feedback to a person playing the machine.

In various embodiments described herein, pinball machine 100 of FIG. 1 may be adapted to receive any of a plurality of different interchangeable, swappable, and/or (re)configurable modular playfield portions. For example, modular playfield portion 201 of FIG. 2 may be one of a plurality of different playfield modules that may be adapted to deploy one or more pinballs 202 onto a playfield and/or to return a pinball to the playfield during a game. In some implementations, modular playfield portion 201 may include barrier element(s) 203, pipe element(s) 204, loops, guides, holes, traps, playfield reducers, or any other pinball component or combinations thereof.

In some implementations, an interchangeable or swappable playfield module may enable a user to organize and/or rearrange playfield modules that are coupled together or to a main playfield portion of a pinball machine. Once coupled to one another, the various playfield modules may provide an entire or combined playfield whereupon a pinball game may be played. In order to modify a game or implement an entirely new game in otherwise the same pinball machine, one or more playfield modules may be removed and replaced with a different playfield module.

In other implementations, a configurable playfield module portion may enable a user to reconfigure that very module by modifying the position, number, and/or type of pinball components coupled thereto. In other words, in a configurable playfield module, pinball components not restricted to a single location and/or whose entities can be replaced by differently shaped pinball components or by pinball components that provide a different operation than the components being replaced. After each reconfiguration, a configurable playfield module may provide a different set of interactions with one or more pinballs and/or with a person playing the machine.

An advantage of a swappable playfield module over a configurable playfield module becomes apparent when there are numerous pinball components attached to the module or when one or more of the pinball components is significantly complex such that it makes it impractical to replace or move the components themselves. In either scenario, moving or replacing any or all of the pinball components may be tedious or impractical, but an entire playfield module may be more easily replaced by another, swappable playfield module.

In yet other implementations, a single pinball machine may be configured to receive interchangeable or swappable modular playfield portions, and one or more of those modular playfield portions may be also have reconfigurable pinball components. As such, various systems and methods described herein may allow for a virtually limitless number of combinations and games to be implemented on a same pinball machine, thus reducing the financial costs that would otherwise be associated with buying entirely new pinball machines every time a new game is desired.

Figure 18:
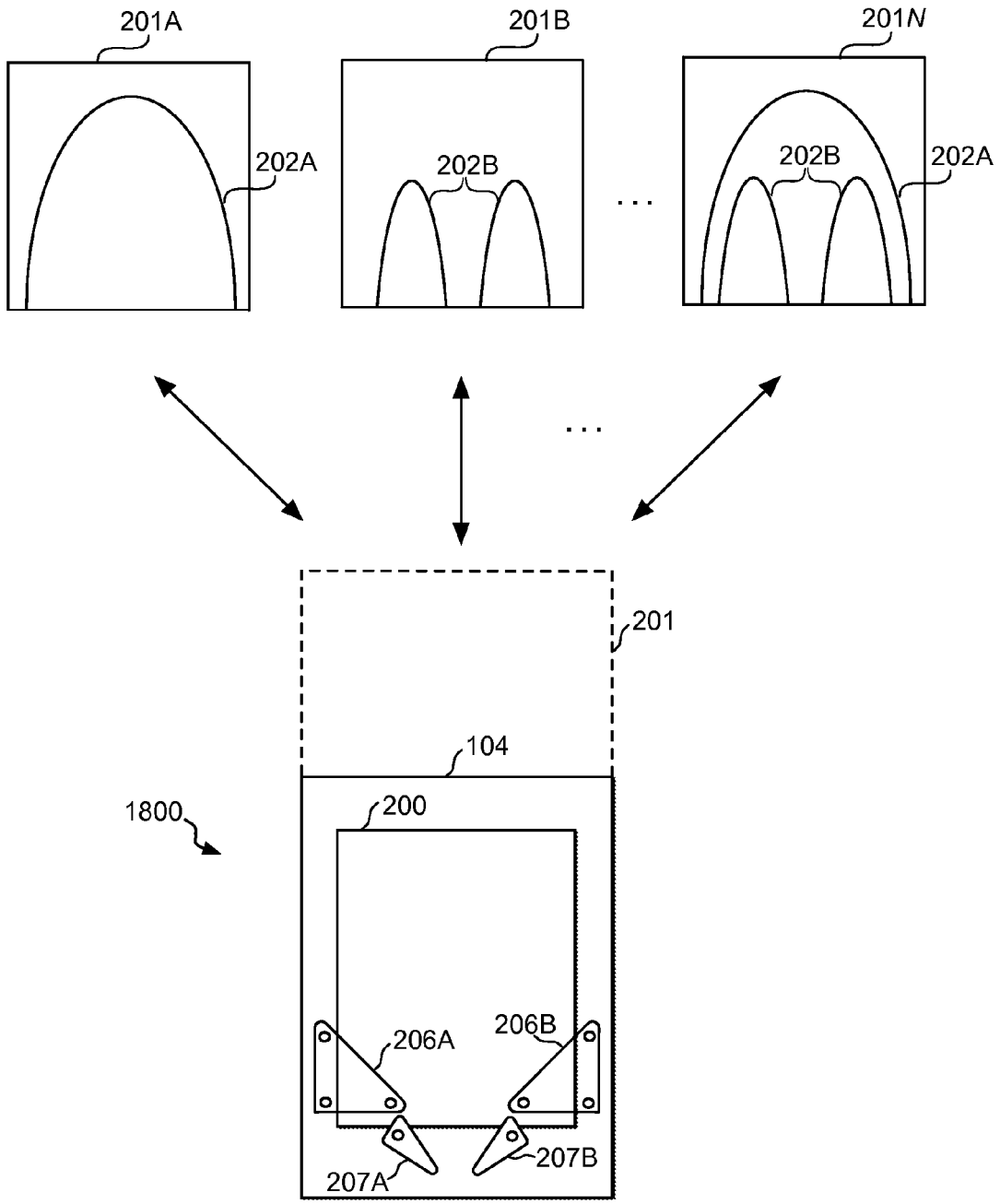
FIG. 18 is a diagram illustrating interchangeable or swappable playfield modules according to some embodiments.

Turning now to FIG. 18, a diagram illustrating interchangeable or swappable playfield modules is depicted. As shown, pinball machine 1800 includes main playfield portion 104 having electronic display 200, flippers 206A/B, and slingshots 207A/B. It should be noted, however, that these components of main playfield portion 104 are shown only by way of example, that that in other implementations other components may be used.

Modular portion 201 may be any of swappable playfield modules 201A-N. To illustrate the distinctions between swappable playfield modules 201A-N, it is noted that module 201A includes large ball guide 202A, module 201B includes two small ball guides 202B, and module 201N includes both large ball guide 202A and small ball guides 202B. More generally, however, each of swappable playfield modules 201A-N may have any suitable combination of pinball components, and may each have a very distinct appearance from one another, whether decoratively or functionally. For example, module 201A may have a cartoon theme corresponding to a children's game, module 201B may have a sci-fi theme for an adult game, and so on.

Main playfield module 104 may have or otherwise be coupled to a set of hardware elements 400 shown in FIGS. 4 and 5. In some embodiments, each of swappable playfield modules 201A-N may also have or otherwise be coupled to one or more of hardware components 400. For example, in some cases, a swappable playfield module may include its own interface board 402, actuator(s) 403, and/or sensor(s) 404. The hardware components of a swappable playfield module (e.g., an interface board) may enable a main playfield module's computing system 401 to control one or more pinball components disposed on the swappable playfield module.

For ease of explanation, hardware components 400 that are directly coupled to main playfield module 104 are referred to as "primary" or "master" components. Additional hardware components 400 that are directly coupled to a swappable playfield module are referred to as "secondary" or "slave" components. In some cases, a secondary interface board 302 (of a swappable playfield module) and a primary interface board (of a main playfield portion) may be both coupled to the same computing system 401. In that case, a single computing system 401 may be capable of controlling elements and detecting events taking place over the entire playfield of a pinball machine.

In some embodiments, in order to couple a swappable playfield module to a main playfield module (or to another swappable playfield module), each module's respective interface board 402 may be communicatively and/or electronically coupled together via an electrical harness, wireless connection, etc. Further, when each module has its own interface board 402, those various boards may be connected in series or in parallel to I/O device 550 and/or network interface 540 of computing system 401.

Figure 19:
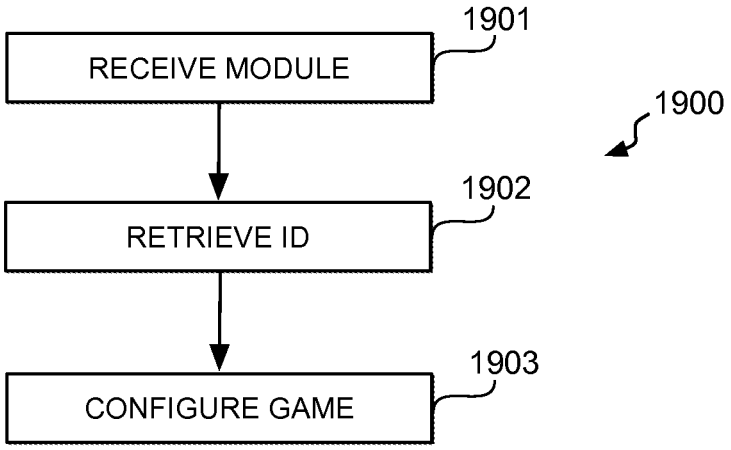
FIG. 19 is a flowchart of an example of a method of using interchangeable or swappable playfield modules according to some embodiments.

FIG. 19 is a flowchart of an example of a method of using interchangeable or swappable playfield modules according to some embodiments. In this example, at block 1901, method 1900 includes receiving a swappable playfield module. For instance, a user may mechanically couple one of a plurality of possible swappable playfield modules 201A-N to a main playfield portion of a pinball machine. The mechanical coupling may be performed via fasteners, supporting mechanisms, or any other suitable way. In addition, one or more secondary hardware components may be communicatively and/or electronically coupled or paired to one or more primary hardware components (e.g., computing system 401). Once coupled together, the swappable playfield module and main playfield portion may appear and operate as single pinball playfield.

At block 1901, method 1900 may include receiving or retrieving an identification from the swappable playfield module. For example, once coupled to each other and powered on, a secondary interface board 402 may transmit, either automatically or upon request, a serial or model number or code to primary computing system 401.

At block 1903, method 1900 may include configuring the pinball machine and/or a game in a manner that utilizes the pinball components of the swappable playfield module. For example, primary computing system 401 may look up configuration data in a game database (e.g., stored in optical or flash memory) or server (e.g., over the Internet), and use that configuration data to control elements and/or detect events taking place at the swappable playfield module of the playfield during a pinball game. Examples of configuration data include, but are not limited to, the number, type, and position of pinball components within the swappable playfield module, as well as rules for operating those components (e.g., when to trap or return a pinball, when to perform a lighting operation, etc.). In this manner, the game software running on the pinball machine can dynamically adjust the game rules depending on which playfield modules are being used at any given time.

In some cases, each swappable playfield module may be associated with its own pinball game such that, upon having its identity recognized by primary computing system 401, primary computing system 401 is capable of either loading a locally stored game or downloading that game from an online game store or repository. In some implementations, at least a portion of the game may be playable and/or visualized through electronic display 200 of the main playfield portion.

In alternative embodiments, at least a portion of the aforementioned configuration data, operating rules, and/or pinball game may be stored in a hardware component that is part of the swappable playfield module. As such, rather than performing the operations of FIG. 19, a primary computing system 401 may obtain some or all of the information necessary to control the swappable playfield module directly from that module itself. In other alternative embodiments, a swappable playfield module may include a secondary computing system and at least some of the control or detection operations taking place with respect to pinball components of the swappable playfield module are performed in parallel with other processing performed by a primary computing system of the main playfield portion.

Figure 20:
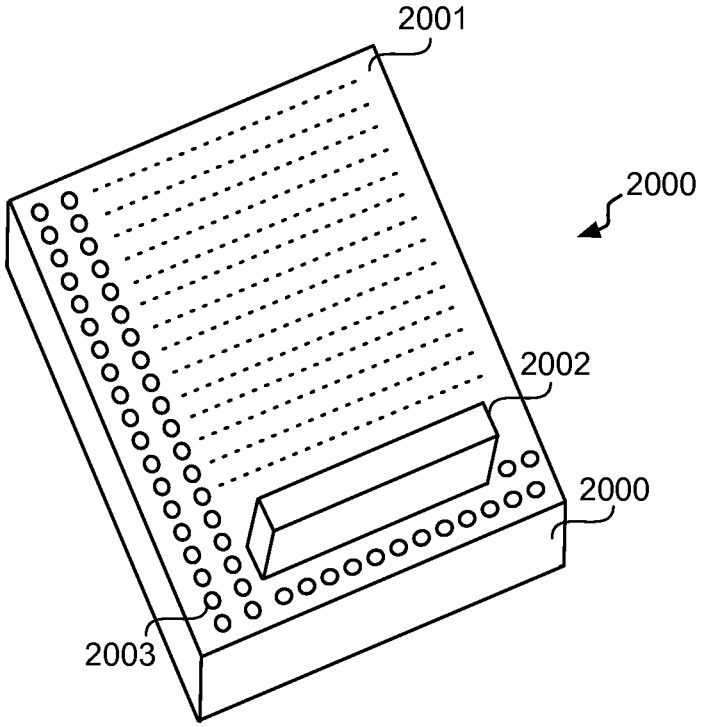
FIG. 20 is a three-dimensional, auxiliary view of an example of a configurable playfield module according to some embodiments.

As noted above, in some embodiments, a playfield module (whether or not interchangeable or swappable) may also be configurable. To illustrate this implementation, FIG. 20 shows a three-dimensional, auxiliary view of an example of a configurable playfield module.

Particularly, configurable playfield module 2000 has a surface 2001 to which one or more pinball components, in this case barrier 2002, may be coupled or mounted. It should be emphasized, however, that any number and/or type of pinball components may be used in other implementations. In some cases, surface 2001 may remain fixed and unchanged, but barrier 2002 may be moved moved and/or replaced by other elements, thereby providing a different set of interactions with one or more pinballs and/or with a person playing the machine.

To allow barrier 2002 to be coupled to surface 2001, surface 2001 may include a matrix of screw-holes 2003 into which barrier 2002 can be secured. In other embodiments, however, any pinball component may be attached to configurable playfield module 2000 by magnets, double-sided tape, or any number of other mechanisms that can hold a pinball component in any specific position at any given time.

An advantage of configurable playfield module 2000 versus a traditional non-modular playfield is that the overall look of the playfield can be changed, as can the entities that interact with one or more pinballs and/or the player playing the game. In some cases, this may result in a game that can present a variety of layouts and features, thereby making a same pinball machine capable of presenting many different sets and styles of interactions.

In some embodiments, in order to facilitate configuration of a pinball machine employing a configurable playfield module, a computer software program may be provided. Such a program may be executed, for example, by computing system 401 of pinball machine 100 using electronic screen 200 as its display interface. In other embodiments, a personal computing system (e.g., desktop computer, laptop, tablet, smart phone, etc.) may be used to execute the configuration software, and any resulting configuration data or file may be then transferred to computing system 401 of pinball machine 100.

Figure 21:
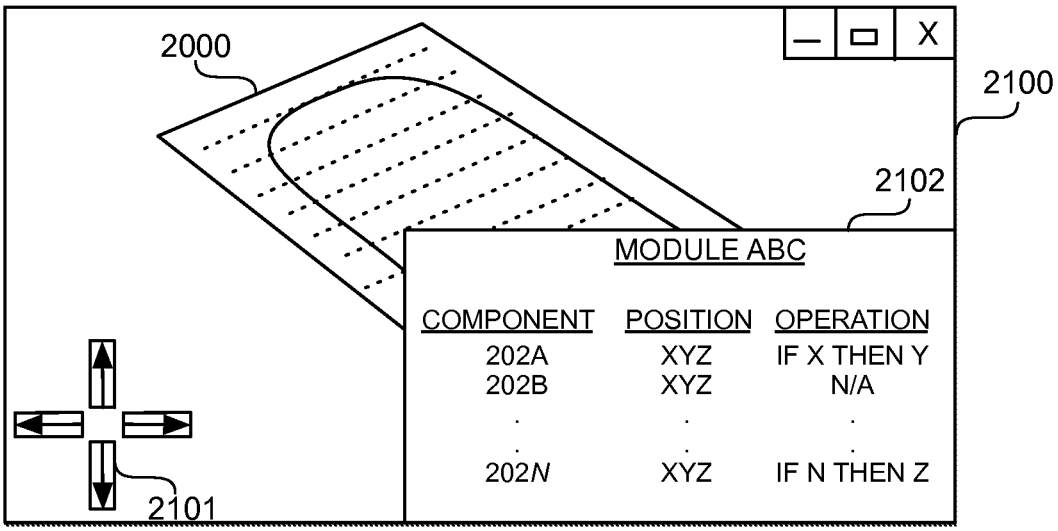
FIG. 21 is a simulated screenshot of an example of a playfield configuration program according to some embodiments.
Figure 22:
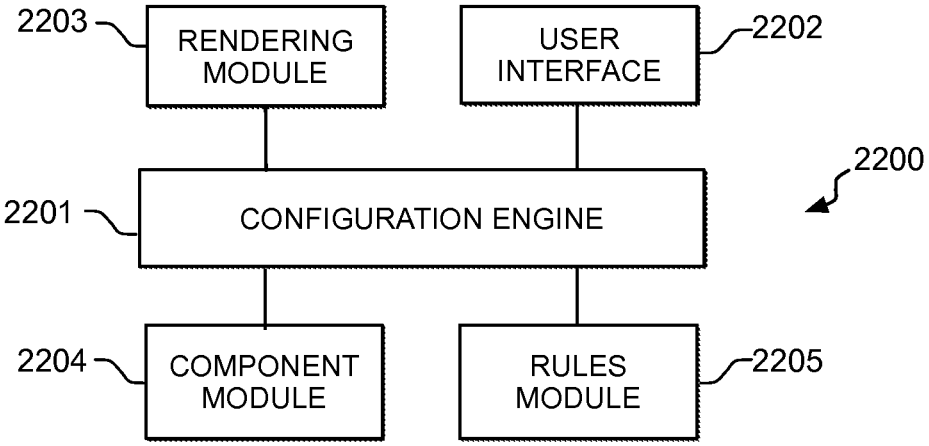
FIG. 22 is a block diagram of an example of a playfield configuration program according to some embodiments.

FIG. 21 is a simulated screenshot and FIG. 22 is a block diagram of an example of playfield module configuration program according to some embodiments. As illustrated, configuration engine 2201 may enable a user via user interface module 2202 to perform one or more playfield module configuration operations. Moreover, rendering module 2203 may cause window 2100 to be presented to the user.

Window 2100 displays a virtualized rendering of a physical, configurable playfield module 2000, similar to that shown in FIG. 20. Using controls 2101 via user interface module 2202, a user may be capable of rotating, translating, magnifying, or otherwise manipulate the rendering of configurable playfield module 2000.

Menu 2102 may list a number of items relevant to the configuration of module 2000. For example, menu 2102 may include an identification of a particular component installed in module 2000, as available in component module 2204, as well as its position of module 2000. Menu 2102 may also include a rule applicable to the corresponding component and stored in rule module 2205. For instance, for any given entry, menu 2102 may display a name of a component, its XYZ coordinates on the surface of module 2000, and, in cases where some action may be perform upon detection of an event, a rule that specifies the event-action pair. An example of such an entry may be to increase the number of game points awarded to a player (i.e., action) in response to the pinball making contact (i.e., event) with a target (i.e., component) located at a given position (i.e., location).

In some embodiments, after having designed a particular configuration for a given playfield module, a user may operate configuration engine 2201 to execute one or more simulations. These simulations may be configured to mimic the performance of the configured playfield module under various game conditions using a physics engine or the like. In this manner, a user may experiment with different pinball component configurations prior to actually assembling the physical parts into a playfield module.

A pinball machine implementing a configurable playfield as described above can provide its owner and players with an infinite number of combinations of playfields. The owner and/or players can make the game feel like an entirely different game by swapping one or more of the playfield modules and/or reconfiguring one or more entities that can be moved or replaced. Therefore, a single pinball machine can provide different features and interactions by having entities on one or more of the small playfields moved or replaced in addition to or instead of having an entire playfield replaced.

As previously noted, a pinball machine with a modular playfield can be considered a multi-game platform. This is in contrast with conventional pinball machines which present a single theme or game to the owner and/or player. The look and feel of a multi-game platform, when employing a modular playfield, can be changed in an infinite number of ways. For example, if a pinball platform is used with a configurable playfield module, numerous pinball components may be swapped in and out or moved on the playfield to present different interactions to the player. Similarly, if the pinball platform is used with swappable playfield modules, numerous new playfield modules may be swapped in and out to present different interactions to the player. Given an infinite number of entities than fit onto a configurable playfield module or an infinite number of swappable playfield modules that may exist, the possible arrangements and types of interactions are also infinite.

Similarly, the software associated with changing the rules based on the identification of a playfield module and/or pinball components may have numerous operating modes, each one based on the type of playfield and or entities that are installed when the software is running. When a playfield module or new pinball component is swapped in, the software may automatically present the player with a different set of rules by which the game is played. Therefore, there may also be an infinite number of different game rules that may be played.

It should be understood that the various operations described herein may be implemented in software executed by processing circuitry, hardware, or a combination thereof. The order in which each operation of a given method is performed may be changed, and various elements of the systems illustrated herein may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. For example, although presented in the context of pinball machines, various systems and methods described herein may be implemented in other types of amusement games. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A pinball machine, comprising:

a main playfield portion having a main playfield surface on which a pinball rolls during normal gameplay of a pinball game and a set of one or more pinball components disposed therein and above the main playfield surface, wherein the set of one or more pinball components is configured to interact with the pinball during the normal gameplay of the pinball game as the pinball rolls on the main playfield surface, wherein the main playfield portion is configured to receive and become mechanically coupled to any of a plurality of interchangeable modular playfield portions, wherein each interchangeable modular playfield portion has a modular playfield surface and a different set of pinball components disposed therein and above the modular playfield surface, each modular playfield surface forming a continuous playfield surface with the main playfield surface when the respective interchangeable modular playfield portion is mechanically coupled to the main playfield portion to allow the pinball to transition from the main playfield portion to the respective interchangeable modular playfield portion and back to the main playfield portion and to mechanically interact with the respective different set of pinball components during the normal gameplay, and wherein the main playfield portion coupled to any one of the plurality of interchangeable modular playfield portions forms a single playfield.

2. The pinball machine of claim 1, further comprising:

a memory configured to store instructions; and processing circuitry operably coupled to the memory, the processing circuitry configured to execute the instructions to cause the pinball machine to:

electronically determine that a selected one of the plurality of interchangeable modular playfield portions is coupled to the main playfield portion;

electronically determine an identification of the selected interchangeable modular playfield portion; and change an aspect of the pinball game based upon the identification.

3. The pinball machine of claim 2, wherein the different set of pinball components includes one or more elements selected from the group consisting of: a ramp, a loop, a target, a barrier, and a hole.

4. The pinball machine of claim 2, wherein the different set of pinball components includes a playfield reducer configured to extend between two outermost lateral edges of the selected interchangeable modular playfield portion, and wherein, upon activation during the normal gameplay of the pinball game, the playfield reducer prevents the pinball from traveling between the main playfield portion and the selected interchangeable modular playfield portion.

5. The pinball machine of claim 2, wherein to change the aspect of the pinball game, the processing circuitry is configured to execute the instructions to cause the pinball machine to retrieve predetermined game settings from a database, the predetermined game settings configured to enable the pinball machine to control the different set of pinball components.

6. The pinball machine of claim 5, wherein the database is accessible to the pinball machine over a computer network.

7. The pinball machine of claim 2, wherein a position of a given component on a surface of the selected interchangeable modular playfield portion is reconfigurable by a user, the processing circuitry further configured to execute the instructions to cause the pinball machine to detect a position of the given component and to change the aspect of the pinball game based upon the detection.

8. The pinball machine of claim 2, wherein the selected interchangeable modular playfield portion is configured to extend a length of the main playfield portion to allow the pinball to travel beyond a surface of the main playfield portion.

9. The pinball machine of claim 4, wherein the playfield reducer includes a barrier and wherein, upon activation, the barrier rises above the main playfield surface of the main playfield portion.

10. The pinball machine of claim 4, wherein the playfield reducer includes a hole and wherein, upon activation, the hole is uncovered.

11. The pinball machine of claim 4, wherein the playfield reducer includes a combination of one or more barrier elements and one or more hole elements and wherein, upon activation, the one or more barrier elements rise above the main playfield surface of the main playfield portion and the one or more hole elements are uncovered.

12. The pinball machine of claim 1, wherein the main playfield portion includes a first pinball rail, wherein a selected interchangeable modular playfield portion of the plurality of interchangeable modular playfield portions includes a second pinball rail, wherein the first and second pinball rails are coupled to each other when the selected interchangeable modular playfield portion is coupled to the main playfield portion to allow the pinball to travel between the main playfield portion and the selected interchangeable modular playfield portion using the first and second pinball rails.

13. A pinball machine comprising:

a main playfield portion having a main playfield surface on which a pinball rolls during normal gameplay of a pinball game, the main playfield portion comprising a flipper component above the main playfield surface, the flipper component being proximate a first end of the main playfield portion, a second end of the main playfield portion being opposite from the first end of the main playfield portion; and an interchangeable modular playfield portion having a modular playfield surface and pinball components above the modular playfield surface, the interchangeable modular playfield portion being distinct and separable from the main playfield portion, the interchangeable modular playfield portion being mechanically coupled to the main playfield portion at the second end of the main playfield portion, the modular playfield surface meeting the main playfield surface at an interface, the modular playfield surface and the main playfield surface forming a continuous playfield surface at the interface, the pinball being allowed to roll from the main playfield surface to the modular playfield surface during normal gameplay of the pinball game, the pinball being allowed to roll from the modular playfield surface to the main playfield surface during normal gameplay of the pinball game.

14. The pinball machine of claim 13, further comprising:

a memory configured to store instructions; and processing circuitry operably coupled to the memory, the processing circuitry configured to execute the instructions to cause the pinball machine to:

electronically determine that the interchangeable modular playfield portions is mechanically coupled to the main playfield portion;

electronically determine an identification of the interchangeable modular playfield portion; and change an aspect of the pinball game based upon the identification.

15. The pinball machine of claim 13, wherein main playfield portion includes a playfield reducer configured to extend along the second end, and wherein, upon activation during the normal gameplay of the pinball game, the playfield reducer prevents the pinball from traveling between the main playfield surface and the modular playfield surface.

16. The pinball machine of claim 13, wherein the modular playfield surface has a matrix of holes therethrough, the pinball components being mounted on the modular playfield surface using connectors through first ones of the matrix of holes, second ones of the matrix of holes not being used to mount another component.

17. A method comprising:

providing a pinball machine comprising a cabinet, a main playfield portion, and a first interchangeable modular playfield portion, the main playfield portion and the first interchangeable modular playfield portion being disposed within the cabinet, the main playfield portion comprising a main playfield surface and a flipper component disposed above the main playfield surface, the flipper component being proximate a first lateral end of the main playfield portion, a second lateral end of the main playfield portion being opposite from the first lateral end of the main playfield portion, the first interchangeable modular playfield portion having a first modular playfield surface and a first set of components above the first modular playfield surface, the first interchangeable modular playfield portion being mechanically coupled to the main playfield portion at the second lateral end of the main playfield portion, the first modular playfield surface meeting the main playfield surface to form a first continuous playfield surface, the pinball being allowed to roll from the main playfield surface to the first modular playfield surface during first normal pinball gameplay, the pinball being allowed to roll from the first modular playfield surface to the main playfield surface during the first normal pinball gameplay;

de-coupling the first interchangeable modular playfield portion from the main playfield portion and removing the first interchangeable modular playfield portion from the cabinet; and after de-coupling and removing the first interchangeable modular playfield portion, mechanically coupling a second interchangeable modular playfield portion to the main playfield portion at the second lateral end of the main playfield portion, the second interchangeable modular playfield portion having a second modular playfield surface and a second set of components above the second modular playfield surface, the second set of components comprising one or more different type, relative location, or arrangement of one or more component from the first set of components, wherein after mechanically coupling the second interchangeable modular playfield portion to the main playfield portion:

the main playfield portion and the second interchangeable modular playfield portion are disposed within the cabinet, and the second modular playfield surface meets the main playfield portion to form a second continuous playfield surface, the pinball being allowed to roll from the main playfield surface to the second modular playfield surface during second normal pinball gameplay, the pinball being allowed to roll from the second modular playfield surface to the main playfield surface during the second normal pinball gameplay.

18. The method of claim 17, further comprising:

using processing circuitry, electronically determining that the second interchangeable modular playfield portions is mechanically coupled to the main playfield portion;

using the processing circuitry, electronically determining an identification of the second interchangeable modular playfield portion; and using the processing circuitry, changing an aspect of the main playfield portion for the second normal pinball gameplay based upon the identification.

19. The method of claim 17, further comprising:

preventing the pinball from traveling between the main playfield surface and the first modular playfield surface or the second modular playfield surface by activating a playfield reducer in the main playfield portion during the first normal pinball gameplay or the second normal pinball gameplay, respectively, the playfield reducer extending along the second lateral end.

20. The method of claim 17, wherein the second modular playfield surface has a matrix of holes therethrough, the second set of components being mounted on the second modular playfield surface using connectors through first ones of the matrix of holes, second ones of the matrix of holes not being used to mount another component.

* * * * *